US009233566B2

(12) United States Patent
Yada et al.

(10) Patent No.: US 9,233,566 B2
(45) Date of Patent: Jan. 12, 2016

(54) PRINTER

(75) Inventors: Yuji Yada, Tokyo (JP); Yoshinori Sata, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 698 days.

(21) Appl. No.: 13/074,087

(22) Filed: Mar. 29, 2011

(65) Prior Publication Data

US 2011/0242250 A1 Oct. 6, 2011

(30) Foreign Application Priority Data

Mar. 31, 2010 (JP) ..... 2010-082986
May 31, 2010 (JP) ..... 2010-124120

(51) Int. Cl.

| | |
|---|---|
| ***B41J 29/13*** | (2006.01) |
| ***B41J 2/14*** | (2006.01) |
| ***B41J 2/16*** | (2006.01) |
| ***B41J 2/05*** | (2006.01) |
| ***B41J 29/02*** | (2006.01) |

(52) U.S. Cl.

CPC ..... *B41J 29/02* (2013.01); *B41J 29/023* (2013.01); *B41J 29/13* (2013.01); *B41J 2/14072* (2013.01); *B41J 2002/14491* (2013.01)

(58) Field of Classification Search

CPC ..... B41J 3/36; B41J 3/445; B41J 29/13; B41J 29/02

USPC ..... 347/109, 108; 346/143, 145; 400/88

See application file for complete search history.

(56) References Cited

U.S. PATENT DOCUMENTS

| | | | | | |
|---|---|---|---|---|---|
| 4,124,151 | A | * | 11/1978 | Hazard | 222/498 |
| 5,322,176 | A | * | 6/1994 | Dubach | 215/235 |
| 5,708,462 | A | * | 1/1998 | Helmbold et al. | 346/136 |
| 5,823,696 | A | | 10/1998 | Harris et al. | |
| 5,842,692 | A | * | 12/1998 | Rutishauser | 271/3.2 |
| 5,980,138 | A | * | 11/1999 | Shiozaki et al. | 400/582 |
| 6,118,469 | A | * | 9/2000 | Hosomi | 347/222 |
| 6,231,214 | B1 | * | 5/2001 | Haugaard | 362/375 |
| 6,443,645 | B1 | | 9/2002 | Takei et al. | |
| 6,831,229 | B1 | * | 12/2004 | Maatta et al. | 174/66 |
| 6,880,929 | B2 | * | 4/2005 | Silverbrook et al. | 347/109 |
| 7,033,097 | B2 | * | 4/2006 | Petteruti et al. | 400/693 |
| 7,275,809 | B2 | | 10/2007 | Uwagaki et al. | |
| 7,287,850 | B2 | * | 10/2007 | Matsui et al. | 347/109 |
| 7,465,109 | B2 | * | 12/2008 | Silverbrook et al. | 400/88 |

(Continued)

FOREIGN PATENT DOCUMENTS

| | | | |
|---|---|---|---|
| JP | 09192006 | A * | 7/1997 |
| JP | 2001010649 | A * | 1/2001 |

(Continued)

*Primary Examiner* — Julian Huffman
*Assistant Examiner* — Leonard S Liang
(74) *Attorney, Agent, or Firm* — IPUSA, PLLC

(57) ABSTRACT

A printer includes a lid part, a body part, a first rotating shaft, a second rotating shaft, a first engaging part having the first rotating shaft removably engaged therewith so as to allow the lid part to be opened and closed relative to the body part, and a second engaging part receiving the second rotating shaft in such a manner as to allow the second rotating shaft to rotate. In response to application of a first predetermined force, the first rotating shaft is removed from the first engaging part while absorbing a second predetermined force from the first predetermined force, and the lid part is allowed to rotate on the second rotating shaft to be opened and closed relative to the body part.

9 Claims, 40 Drawing Sheets

(56) References Cited

U.S. PATENT DOCUMENTS

| | | | | |
|---|---|---|---|---|
| 7,872,662 | B2 | 1/2011 | Ochiai et al. | |
| 8,068,127 | B2 | 11/2011 | Ochiai et al. | |
| 8,072,476 | B2 | 12/2011 | Ochiai et al. | |
| 8,350,881 | B2 | 1/2013 | Ochiai et al. | |
| 2001/0054383 | A1* | 12/2001 | Pu et al. | 118/723.001 |
| 2004/0070662 | A1 | 4/2004 | Shimoda | |
| 2004/0113965 | A1 | 6/2004 | Kosugi et al. | |
| 2005/0012810 | A1* | 1/2005 | Silverbrook | 347/109 |
| 2005/0162497 | A1* | 7/2005 | Matsui et al. | 347/109 |
| 2005/0207813 | A1* | 9/2005 | Takabatake et al. | 400/88 |
| 2005/0243159 | A1* | 11/2005 | Nakatani | 347/197 |
| 2007/0052219 | A1 | 3/2007 | Rust et al. | |
| 2007/0138193 | A1* | 6/2007 | Aono et al. | 220/810 |
| 2009/0285615 | A1* | 11/2009 | Matsubayashi et al. | 400/208 |
| 2010/0247217 | A1 | 9/2010 | Tsugaru et al. | |
| 2012/0081491 | A1* | 4/2012 | Okumura | 347/108 |
| 2013/0050381 | A1* | 2/2013 | Okumura et al. | 347/108 |

FOREIGN PATENT DOCUMENTS

| | | | |
|---|---|---|---|
| JP | 2003147796 | A * | 5/2003 |
| JP | 2004018038 | A * | 1/2004 |
| JP | 2004-122492 | | 4/2004 |
| JP | 2004-136639 | | 5/2004 |
| JP | 2007-015314 | | 1/2007 |

* cited by examiner

PRINTER

CROSS-REFERENCE TO RELATED APPLICATIONS

The present application is based upon and claims the benefit of priority of Japanese Patent Application No. 2010-082986, filed on Mar. 31, 2010, and Japanese Patent Application No. 2010-124120, filed on May 31, 2010, the entire contents of which are incorporated herein by reference.

BACKGROUND OF THE INVENTION

1. Field of the Invention

The present invention relates to portable printers.

2. Description of the Related Art

FIG. 1 is a perspective view of a conventional portable printer (hereinafter simply referred to as "printer"). As illustrated in FIG. 1, the printer includes a lid part 2 and a body part 4. FIG. 1 illustrates a state where the lid part 2 is closed. FIG. 2 is a perspective view of the printer with the lid part 2 being open.

FIG. 3 is a cross-sectional view of the printer with the lid part 2 being closed. FIG. 4 is a cross-sectional view of the printer with the lid part 2 being open. The lid part 2 is opened or closed about a support shaft 5. The support shaft 5 is rotatably received by a bearing member 7.

Further, a mark detecting part 6 is provided on the lid part 2. A control part (not graphically illustrated) recognizes a printing position on paper 8 by the mark detecting part 6 detecting a mark added to the paper 8 from a paper roll 82. Further, as illustrated in FIG. 4, the mark detecting part 6 is disposed at an end of the lid part 2, and a flexible printed circuit (FPC) 10 is provided along the lid part 4. The mark detecting part 6 outputs a mark detecting signal in response to detection of the mark, and the mark detection signal is transmitted to the control part via the FPC 10.

SUMMARY OF THE INVENTION

According to an aspect of the present invention, a printer includes a lid part; a body part; a first rotating shaft; a second rotating shaft; a first engaging part having the first rotating shaft removably engaged therewith so as to allow the lid part to be opened and closed relative to the body part; and a second engaging part receiving the second rotating shaft in such a manner as to allow the second rotating shaft to rotate, wherein in response to application of a first predetermined force, the first rotating shaft is removed from the first engaging part while absorbing a second predetermined force from the first predetermined force, and the lid part is allowed to rotate on the second rotating shaft to be opened and closed relative to the body part.

According to an aspect of the present invention, a printer includes a lid part; a body part; a control part provided in the body part; a mark detecting part provided on the lid part and configured to output a mark detection signal in response to detecting a mark added to paper; a transmission part configured to transmit the mark detection signal from the mark detecting part to the control part and having a slack part configured to extend and contract; and a housing part configured to house the slack part of the transmission part and to extend and contract in directions in which the slack part is configured to extend and contract.

According to an aspect of the present invention, a printer includes a body part; a lid part configured to be opened and closed relative to the body part; a paper housing part configured to house paper; a control part provided in the body part; a mark detecting part provided in the body part and configured to detect a mark added to the paper; a moving part configured to move the mark detecting part, in response to closure of the lid part, to a detection-enabled position where the mark detecting part is configured to detect the mark, and to move the mark detecting part out of a paper housing path in response to opening of the lid part, the paper housing path being a path through which the paper is housed into the paper housing part.

According to an aspect of the present invention, a printer includes a lid part; a body part; a mark detecting part provided in the body part and configured to detect a mark added to a reverse side of paper with a mark reading surface of the mark detecting part being opposed to the reverse side of the paper; and an opposing part provided on a conveyance path in which the paper is conveyed, and configured to cause the reverse side of the paper to be opposed to the mark reading surface of the mark detecting part.

According to an aspect of the present invention, a printer includes a mark detecting part configured to output a first detection current in response to detecting a mark added to paper; a pair of first coils configured to supply a first drive current for driving the mark detecting part; a pair of second coils; and a control part, wherein the pair of first coils is configured to generate the first drive current with electromagnetic induction caused by a second drive current supplied from the control part, and the pair of second coils is configured to generate a second detection current with electromagnetic induction caused by the first detection current from the mark detecting part, and to supply the second detection current to the control part.

According to an aspect of the present invention, a printer includes a lid part; a body part; a rotating shaft; an engaging part having the rotating shaft removably engaged therewith so as to allow the lid part to be opened and closed relative to the body part; a mark detecting part provided on the lid part and configured to output a mark detection signal in response to detecting a mark added to paper; a transmission part configured to transmit the mark detection signal from the mark detecting part to the control part; and a connecting part, wherein the lid part and the body part are caused to be separated from each other and the transmission part is caused to be separated into multiple portions by removal of the rotating shaft from the engaging part, and the connecting part is configured to electrically connect the portions of the separated transmission part upon engagement of the rotating shaft with the engaging part.

The object and advantages of the embodiments will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

The conventional printer as described above with reference to FIG. 1 through FIG. 4 has a problem in that if an excessive force is applied when a user tries to open the lid part 2 in the state of FIG. 3, the support shaft 5 or the bearing member 7 cannot withstand the excessive force so that the support shaft 5 or the bearing member 7 is broken to separate the lid part 2 and the body part 4, thus resulting in breakage of the FPC 10.

Figure 1:
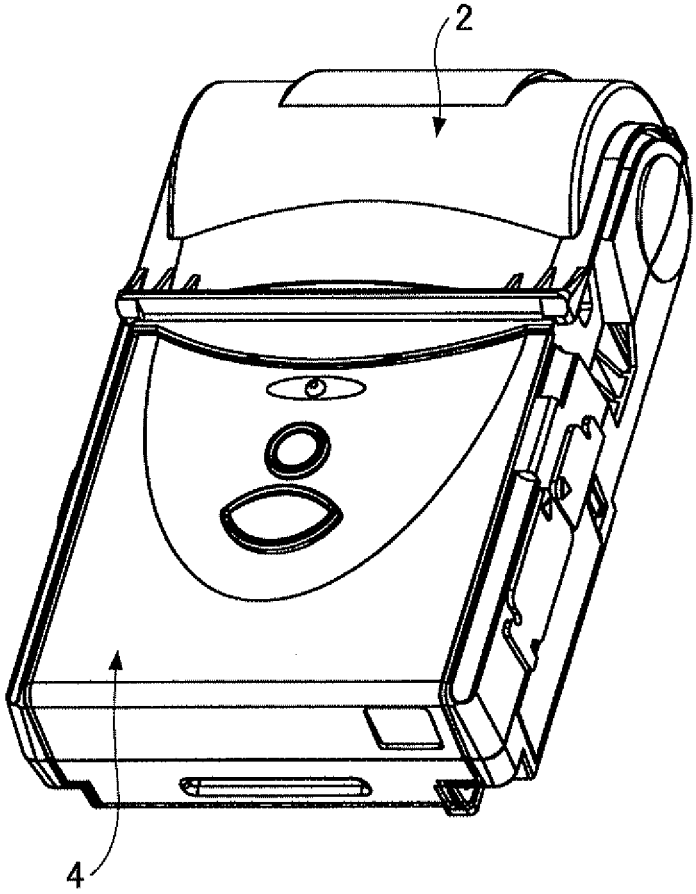
FIG.1 RELATED ART
FIG. 1 is a perspective view of a conventional portable printer with a lid part closed.
Figure 2:
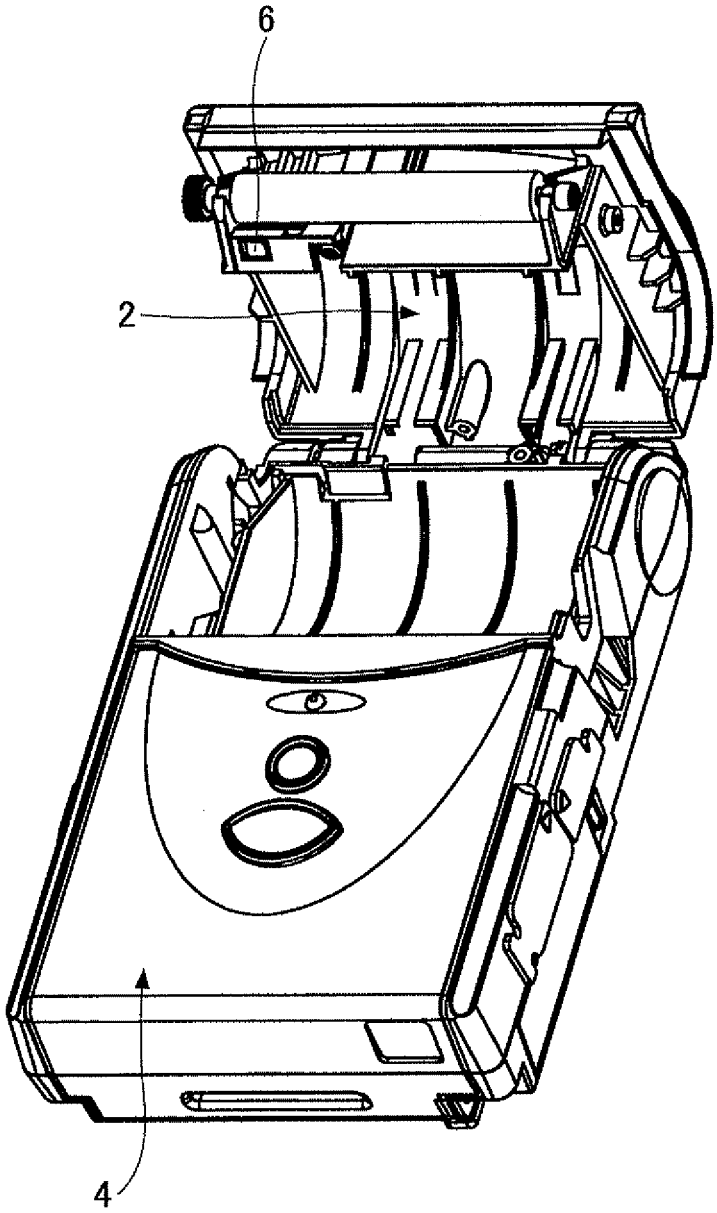
FIG.2 RELATED ART
FIG. 2 is a perspective view of the conventional printer with the lid part open.
Figure 3:
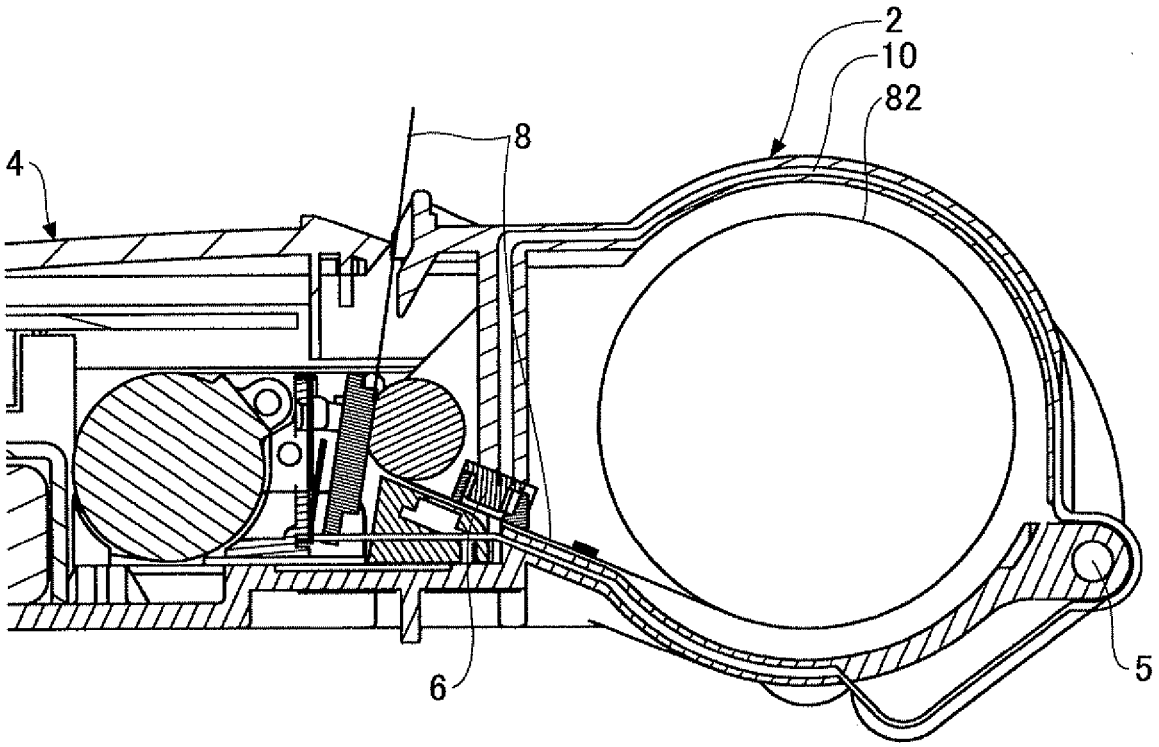
FIG.3 RELATED ART
FIG. 3 is a cross-sectional view of the conventional printer with the lid part closed.
Figure 4:
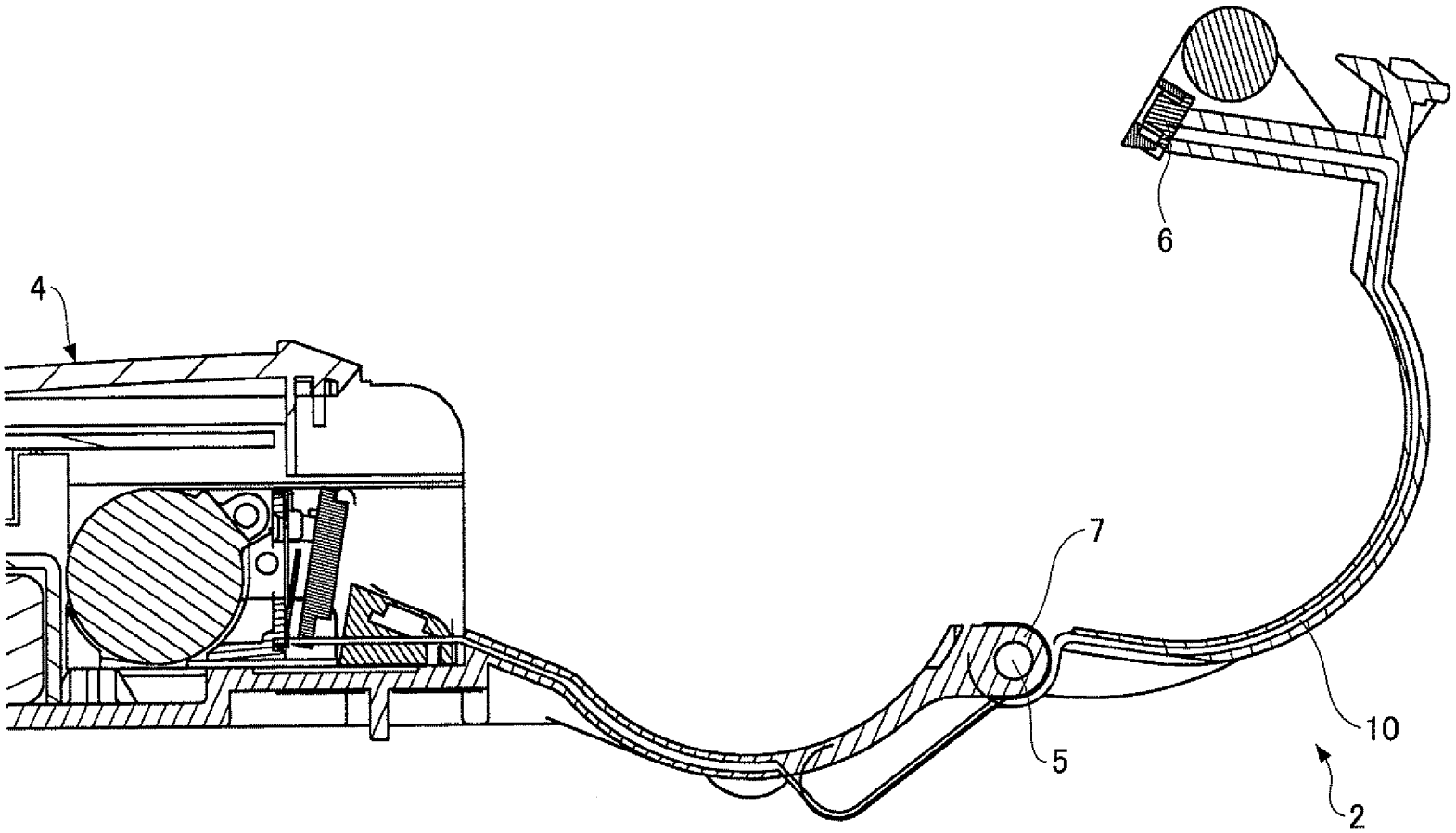
FIG.4 RELATED ART
FIG. 4 is a cross-sectional view of the conventional printer with the lid part open.

Further, as illustrated in FIG. 3 and FIG. 4, in the case where the mark detecting part 6 is provided at the end of the lid part 2, the mark detecting part 6 and the control part (not graphically illustrated) is connected via a transmission part such as the FPC 10 in order to transmit the mark detection signal output from the mark detecting part 6 to the control part. In the case as illustrated in FIG. 3, where the lid part 2 has a curved shape, the transmission part is provided along the shape of the lid part 2.

According to an aspect of the present invention, a printer is provided that prevents separation of a lid part and a body part and thus prevents breakage of an FPC even if an excessive force is applied when a user opens the lid part or the printer is dropped with the lid part open.

Further, as illustrated in FIG. 3 and FIG. 4, the FPC 10 (transmission part) is provided without clearance. Accordingly, there is a problem in that if a user opens the lid part 2 in the closed state (the state of FIG. 3) with application of an excessive force or if a user inadvertently drops the printer with the lid part 2 open (the state of FIG. 4), the lid part 2 and the body part 4 are separated so that the transmission part may also be severed (separated) or broken.

According to an aspect of the present invention, a printer is provided that prevents a transmission part from being severed or broken even if a lid part and a body part are separated in cases such as when a user opens the lid part with an excessive force.

Figure 5:
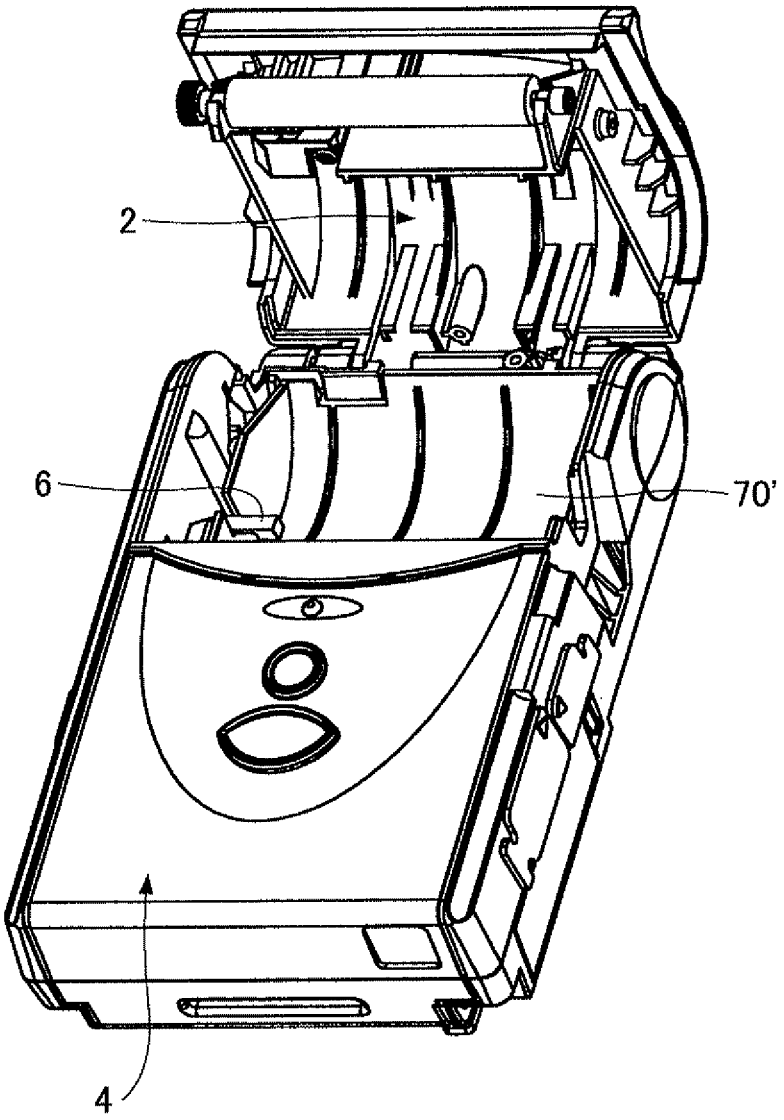
FIG.5 RELATED ART
FIG. 5 is a perspective view of a conventional printer with the lid part open in the case of providing a mark detecting part in a body part.

Further, in printers with a mark detecting part, generally, the mark detecting part is provided on a lid part. On the other hand, a printer is proposed that has a mark detecting part provided in a body part in order to save the trouble of providing a transmission part from the mark detecting part to a control part. FIG. 5 is a perspective view of a conventional printer with the lid part 2 open in the case of providing the mark detecting part 6 in the body part 4.

In the case of providing the mark detecting part 6 in the body part 4, however, there is a problem in that the hindrance of the mark detecting part 6 makes it difficult for an operator to house a paper roll in a paper roll housing part 70'.

According to an aspect of the present invention, a printer is provided that makes it easy for an operator to house a paper roll in a paper roll housing part even in the case of providing a mark detecting part in a body part.

Further, as described above, generally, the mark detecting part 6 is provided on the lid part 2 as illustrated in FIG. 4. However, it is necessary to provide the transmission part (FPC 10) between the mark detecting part 6 and the control part in order to transmit a mark detection signal from the mark detecting part 6 to the control part. Further, a printer is proposed that has the mark detecting part 6 disposed in the body part 4 in order to save the trouble of providing the transmission part (FPC 10).

The mark detecting part 6 is configured to detect a mark added in advance to the reverse side of the paper 8, and generally, is an optical sensor. That is, the mark detection part 6 includes a light-emitting part configured to emit light toward the reverse side of the paper 8 and a light-receiving part (that is, the reading surface of the mark detecting part 6) configured to receive light reflected back from the reverse side of the paper 8. The mark detecting part 6 determines the presence or absence of the mark by measuring the level of the received light (light reception level).

That is, it is desired that the reading surface of the mark detecting part 6 and the reverse side of the paper 8 are completely opposed to each other. However, there is a problem in that in the case of providing the mark detecting part 6 in the body part 4, it is difficult to have the reading surface of the mark detecting part 6 and the reverse side of the paper 8 opposed completely to each other.

According to an aspect of the present invention, a printer is provided that properly detects a mark added to the reverse side of paper while having a mark detecting part in a body part.

Figure 6:
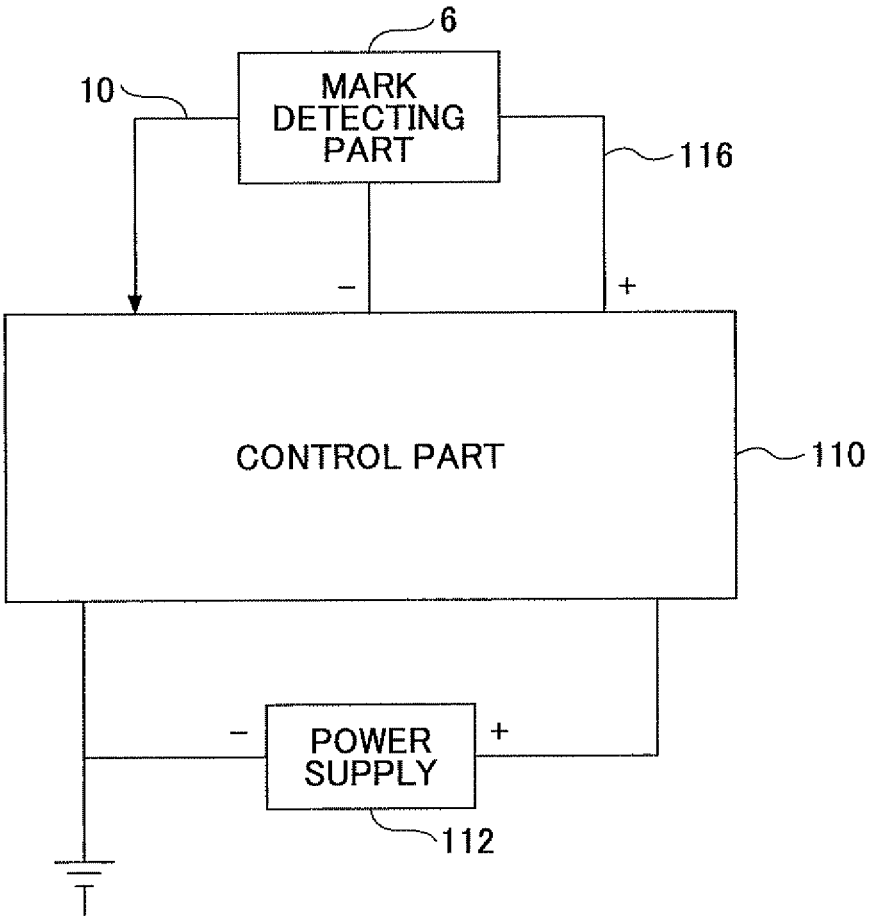
FIG.6 RELATED ART
FIG. 6 is a diagram illustrating a circuit including the mark detecting part.

Further, generally, the mark detecting part 6 is provided on the lid part 2 as illustrated in FIG. 3 and FIG. 4. FIG. 6 is a diagram illustrating a circuit including the mark detecting part 6. A description is given, using FIG. 3, FIG. 4, and FIG. 6, of a conventional printer.

Referring to FIG. 6, a control part 110 is provided on the body part 40 side. In order to transmit a mark detection signal from the mark detecting part 6 to the control part 110, it is necessary to provide the FPC 10 (transmission part) between the mark detecting part 6 and the control part 110.

Further, in order to drive the mark detecting part 6, an electric current is supplied from a power supply 112 to the control part 110. The control part 110 feeds the supplied electric current to the mark detecting part 60 through a power feed line 116.

As described above, it is necessary to provide the FPC 10 and the power feed line 116. Accordingly, there is the problem of high cost. Further, for example, in unexpected circumstances such as when a user opens the lid part 2 with an excessive force, the bearing member 7 may be broken so that the support shaft 5 may not be received (supported) by the bearing member 7. In this case, the lid part 2 and the body part 4 are separated, so that the FPC 10 is severed (separated) or broken. The severance (separation) or breakage of the FPC 10 causes a problem in that the mark detection signal from the mark detecting part 6 may not be transmitted to the control part 110. Further, there is also a problem in that such an unexpected circumstance may break the power feed line 116 to prevent electric power from being supplied to the mark detecting part 6.

According to an aspect of the present invention, a printer is provided that is free from the above-described problems.

Further, in the case of integrating the separated lid part 2 and body part 4 and in the case of restoring (connecting the pieces or portions of) the broken or severed FPC 10, an extremely complicated operation is needed.

According to an aspect of the present invention, a printer is provided that makes it possible to easily restore the connection even if the lid part 2 and the body part 4 are separated and even if the FPC 10 is broken or severed because of an unexpected circumstance.

A description is given below, with reference to the accompanying drawings, of embodiments of the present invention. In the following description, elements or components having the same function are referred to by the same reference character or numeral, and are not redundantly described.

[a] First Embodiment

Figure 7:
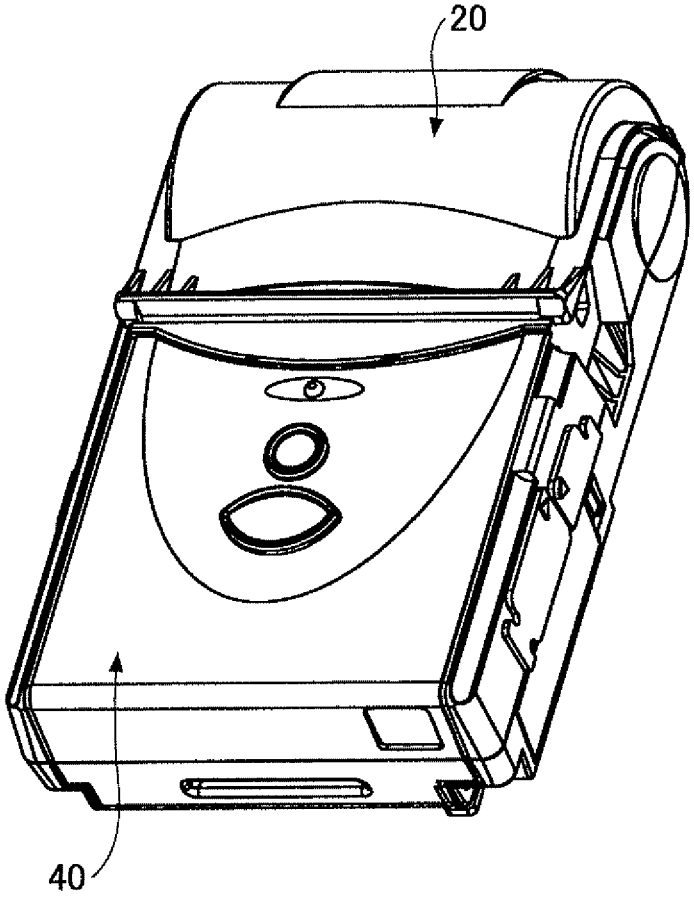
FIG. 7 is a perspective view of a printer with a lid part closed according to a first embodiment of the present invention.
Figure 8:
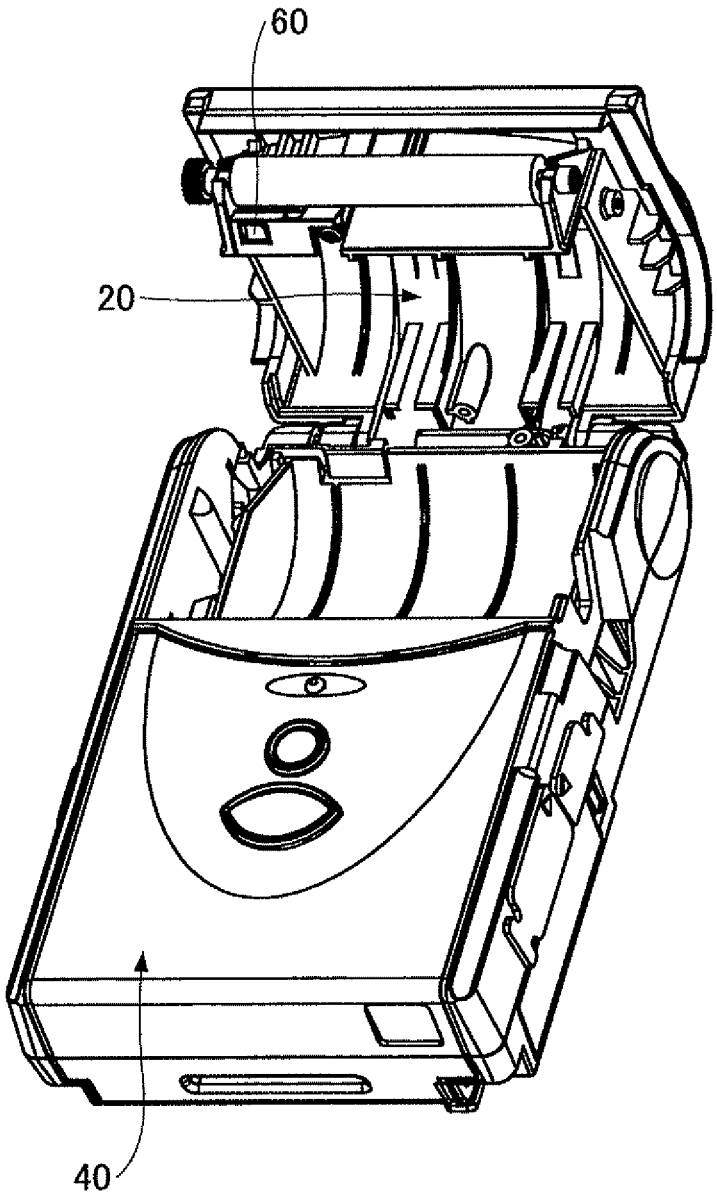
FIG. 8 is a perspective view of the printer with the lid part open according to the first embodiment of the present invention.

An overview is given of a printer according to a first embodiment. FIG. 7 is a perspective view of the printer of this embodiment with a lid part 20 closed relative to a body part 40. The printer of this embodiment may have the same exterior as the conventional printer of FIG. 1 in a perspective view. Referring to FIG. 7, the printer of this embodiment includes the lid part 20 and the body part 40. The lid part 20 is configured to be opened and closed relative to the body part 40. FIG. 8 is a perspective view of the printer of this embodiment with the lid part 20 open relative to the body part 40, which may be the same as the perspective view of FIG. 2. Referring to FIG. 8, a mark detecting part 60 is provided on the inside of the lid part 20.

Figure 9:
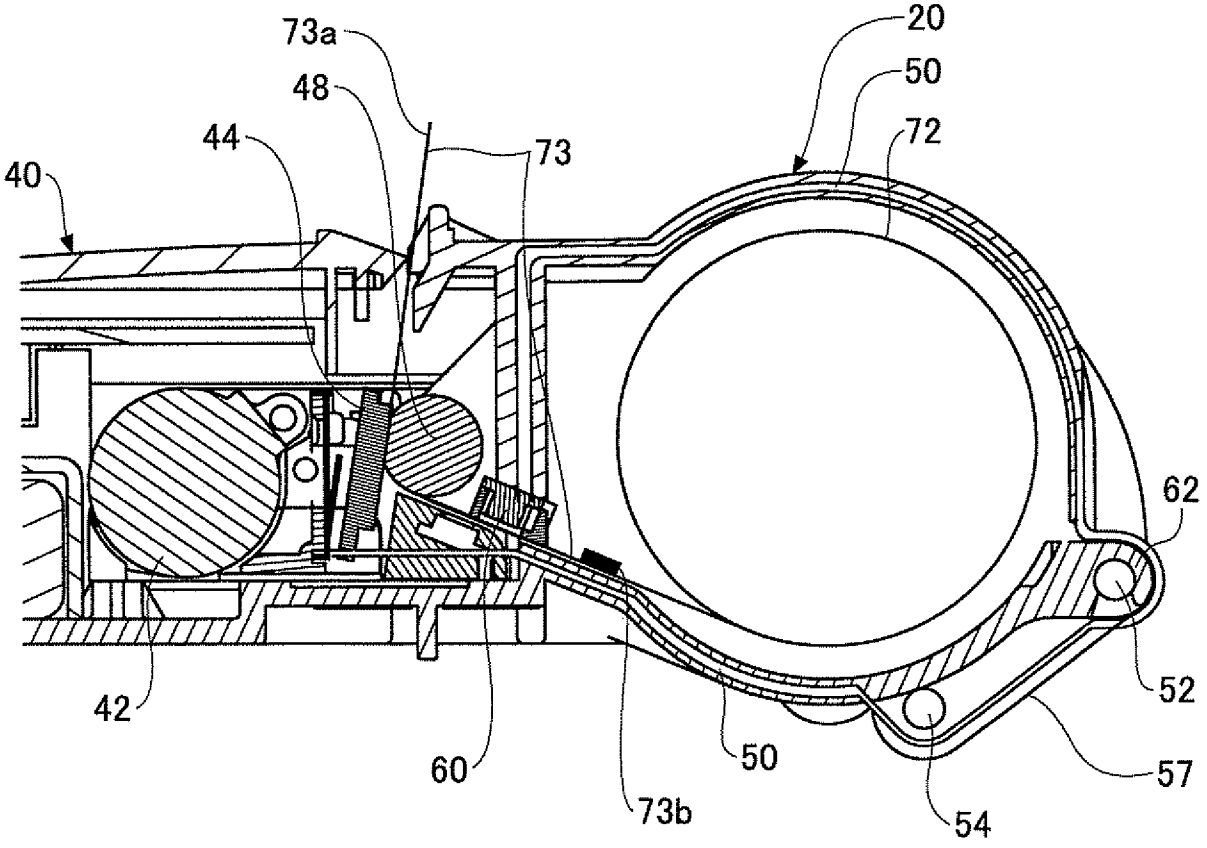
FIG. 9 is a cross-sectional view of the printer with the lid part closed according to the first embodiment of the present invention.
Figure 10:
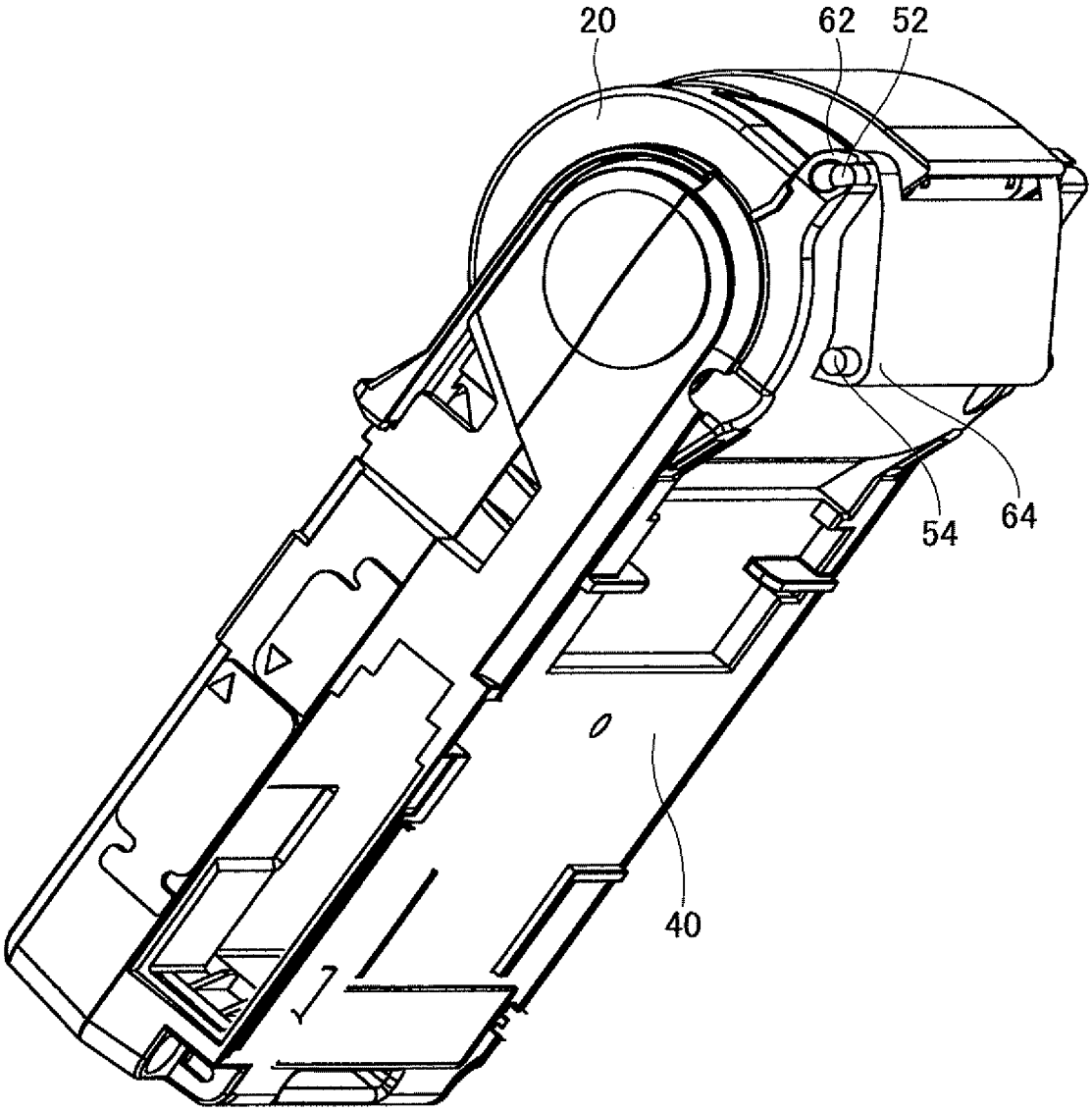
FIG. 10 is a rear-side perspective view of the printer with the lid part closed according to the first embodiment of the present invention.

FIG. 9 is a cross-sectional view of the printer with the lid part 20 closed relative to the body part 40. FIG. 10 is a perspective view of the printer with the lid part 20 closed relative to the body part 40, taken from an angle different from that of FIG. 7. Referring to FIG. 9 and FIG. 10, the printer includes a motor 42, a printing head 44, the mark detecting part 60, a platen roller 48, an FPC 50, a first rotating shaft 52, and a second rotating shaft 54.

According to this embodiment, the first rotating shaft 52 of the printer is engaged with a first engaging part 62 so as to allow the lid part 20 to rotate (be opened and closed) relative to the body part 40. The lid part 20 is configured to be opened and closed relative to the body part 40 by an operator rotating the lid part 20. Further, the second rotating shaft 54 is engaged with a second engaging part (bearing part) 64 so as to allow the lid part 20 to rotate relative to the body part 40. The first rotating shaft 52, the second rotating shaft 54, the first engaging part 62, and the second engaging part 64 are united through a junction member 57.

Figure 11:
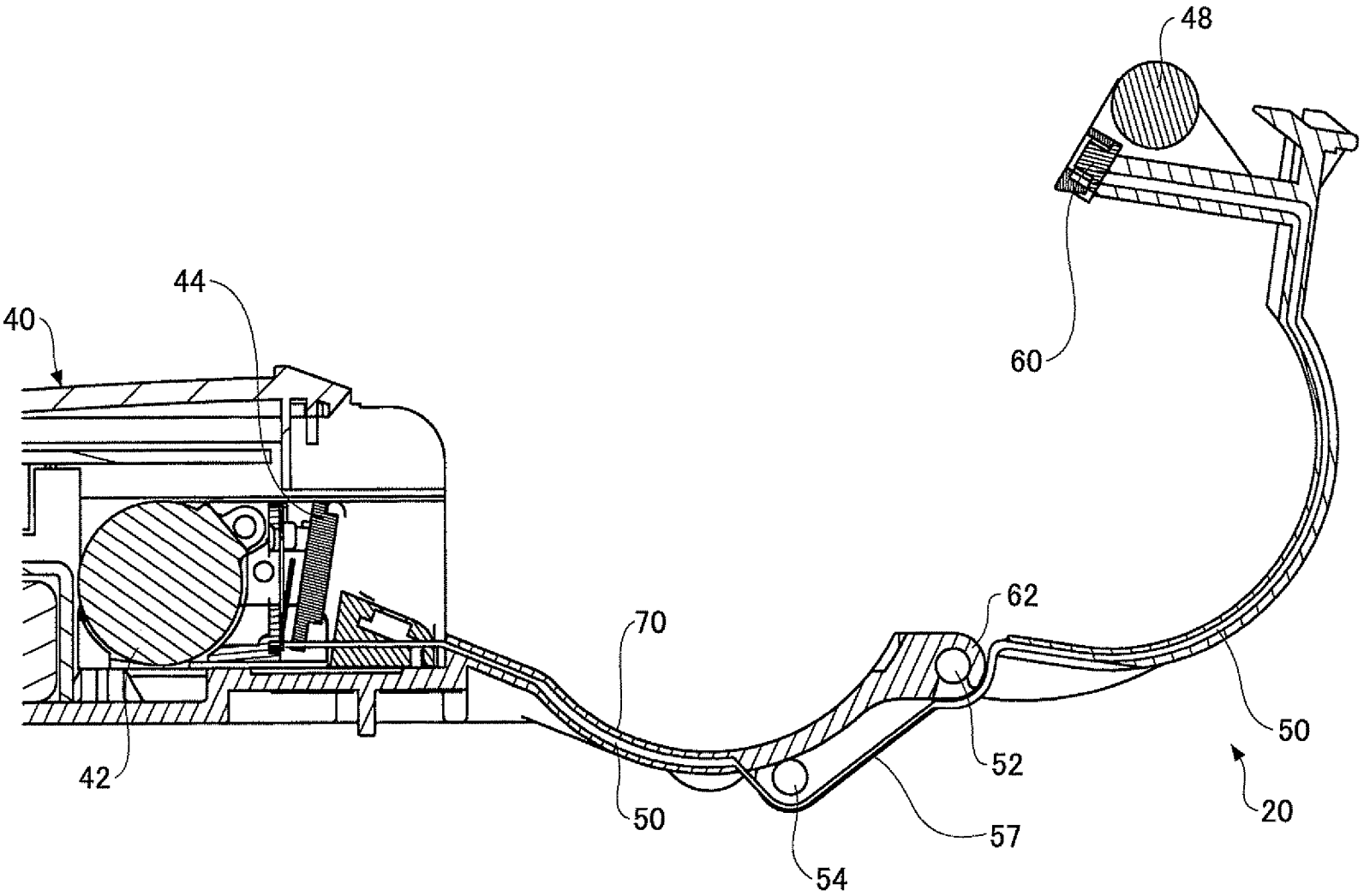
FIG. 11 is a cross-sectional view of the printer with the lid part open according to the first embodiment of the present invention.

FIG. 11 is a cross-sectional view of the printer with the lid part 20 rotated on the first rotating shaft 52 in a direction away from the body part 40 to be open relative to the body part 40. Referring to FIG. 11, the platen roller 48 and the mark detecting part 60 are provided on the lid part 20. The mark detecting part 60 is configured to detect a mark 73*b* (FIG. 9) added in advance to the reverse side of paper 73. The mark detecting part 60 is configured to output a mark detection signal in response to detection of the mark 73*b*.

In the case illustrated in FIG. 11, the mark detecting part 60 is disposed at an end of the lid part 20. Further, the mark detection signal output from the mark detecting part 60 is transmitted by the FPC 50 to reach a control part (not graphically illustrated).

The printer includes a transmission part that includes a coaxial cable (not graphically illustrated) and the FPC 50. The transmission part is provided along the length of the lid part 20 between its exterior surface and interior surface to be connected to the control part (not graphically illustrated). In the following, the transmission part is described as the FPC 50.

Further, the lid part 20 is opened to form a paper roll housing part 70. An operator loads the paper roll housing part 70 with a paper roll 72 (sets the paper roll 72 in the paper roll housing part 70), and closes the lid part 20. When the lid part 20 is closed, the printing head 44 and the platen roller 48 come into press contact, so that the press contact portion of the printing head 44 and the platen roller 48 serves as a printing part. This printing part prints letters, characters, etc., on a printing surface 73*a* (FIG. 9) of the paper 73. Further, in response to the closure of the lid part 20, the leading end of the paper roll 72 is conveyed to the printing part under the control of the control part.

When the control part transmits a print job to the printing head 44, printing is performed on the printing surface 73*a* of the paper 73. Further, the motor 42 serves as a drive source of a heat supply, etc., to the printing head 44.

Next, a description is given of the first engaging part 62, etc., of this embodiment.

Figure 12B:
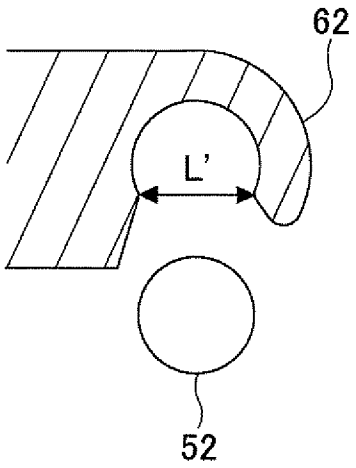
FIGS. 12A and 12B are diagrams illustrating the relationship between a first rotating shaft and a first engaging part according to the first embodiment of the present invention.
Figure 12A:
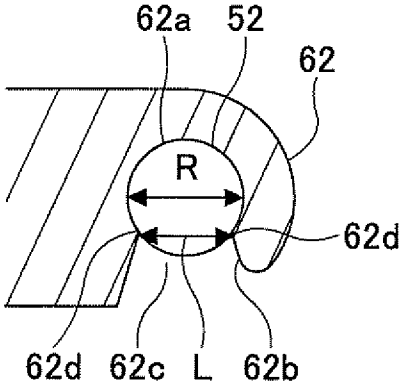

FIGS. 12A and 12B are enlarged views of the first engaging part 62 and the first rotating shaft 52. As illustrated in FIG. 12A, the first engaging part 62 includes a through hole 62*a* and a cut part 62*b*. The cut part 62*b* is provided to form a gap 62*c*. Further, the size of the gap 62*c* (hereinafter referred to as "gap size") is defined as L. The diameter R of the first rotating shaft 52 is greater than the gap size L. In the state of FIG. 12A, the first rotating shaft 52 is rotatably engaged with the first engaging part 62. Then, as described above, the first rotating shaft 52 rotates to cause the lid part 20 to rotate relative to the body part 40. Further, the first engaging part 62 is formed of such an elastic material as to allow the gap size L to slightly increase (allow the gap 62*c* to slightly widen).

It is assumed that an operator opens the lid part 20 with an excessive force (which may hereinafter be referred to as "fifth predetermined force"). That is, it is assumed that an excessive force is applied to the lid part 20 in a direction in which the lid part 20 opens. In this case, a first predetermined force F is applied to the first rotating shaft 52 in the direction of the gap 62*c* (that is, in a direction for the first rotating shaft 52 to be removed from the first engaging part 62). Then, as illustrated in FIG. 12B, the gap size L increases to become a gap size L' while the first rotating shaft 52 is moving in the direction of the gap 62*c*. As a result, the first rotating shaft 52 comes off the through hole 62*a* and passes through the cut part 62*b* so as to be disengaged (removed) from the first engaging part 62. That is, the first rotating shaft 52 is removably engaged with the first engaging part 62.

Here, at the time of removal from the first engaging part 62, since the first rotating shaft 52 is in contact with contact surfaces 62*d* (FIG. 12A) of the first engaging part 62, the contact surfaces 62*d* absorbs a second predetermined force f from the first predetermined force F. That is, when the first rotating shaft 52 is removed from the first engaging part 62, the second predetermined force f is absorbed from the first predetermined force F.

Figure 13:
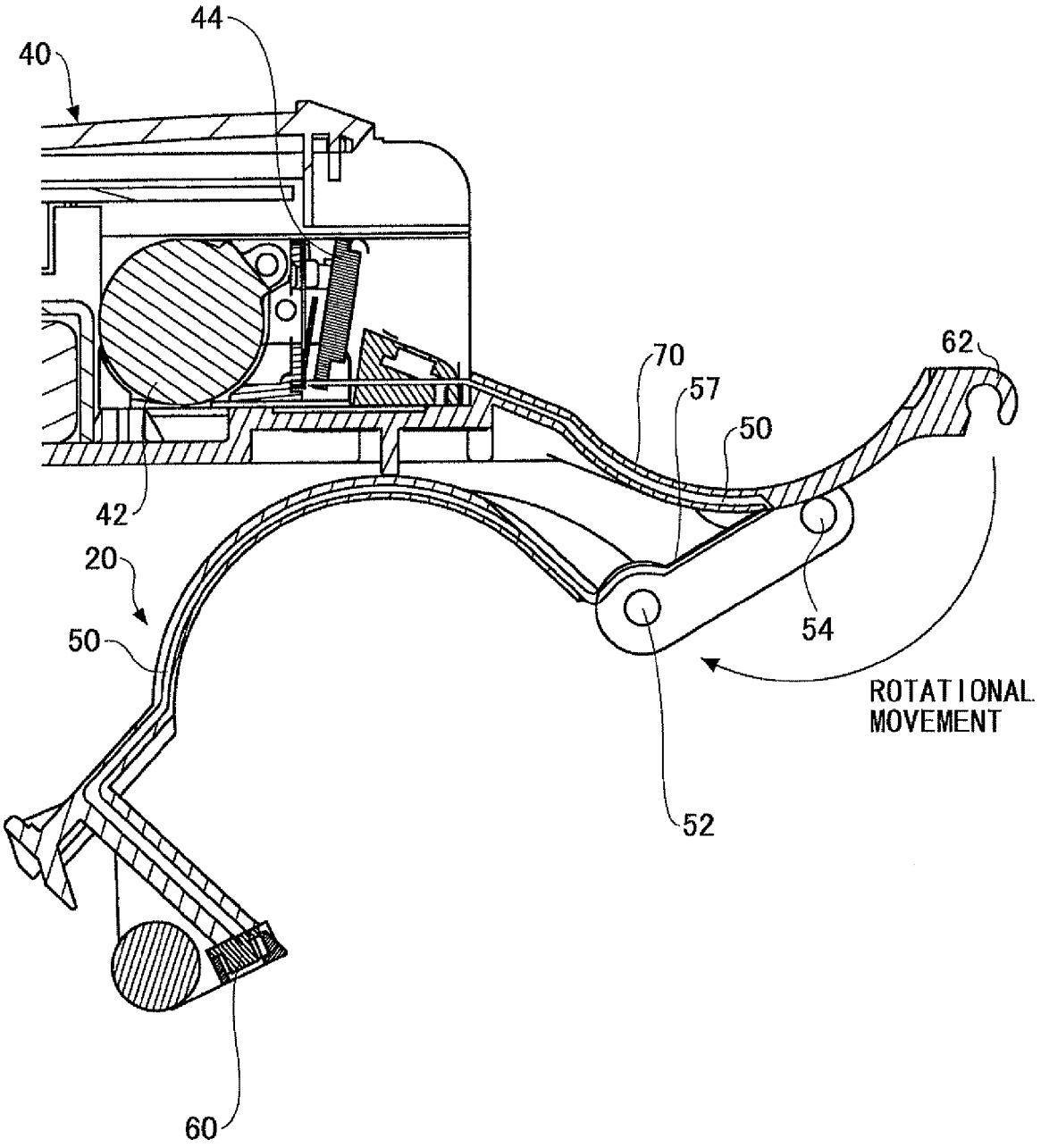
FIG. 13 is a cross-sectional view of the printer with the lid part open according to the first embodiment of the present invention.
Figure 14:
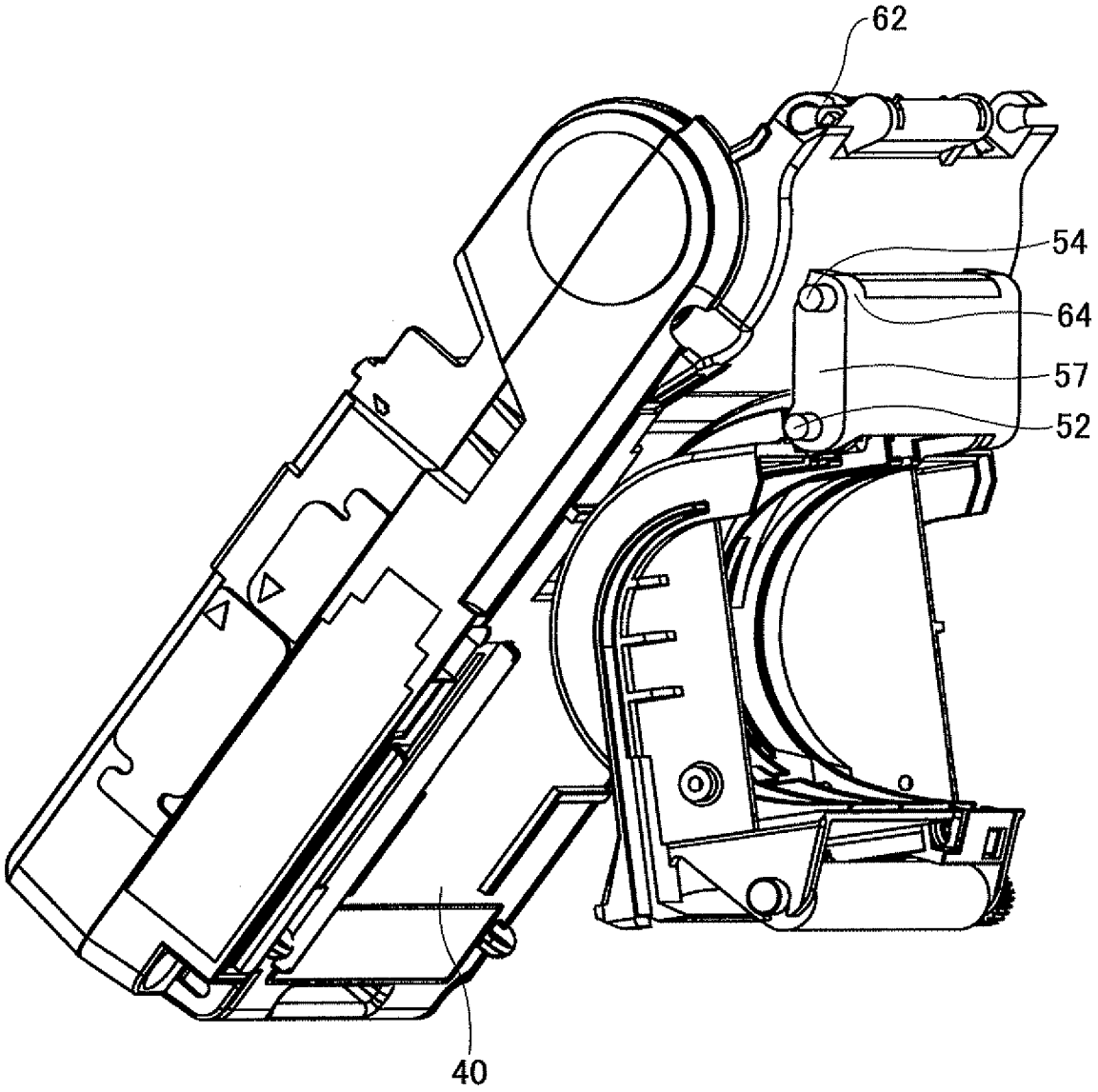
FIG. 14 is a rear-side perspective view of the printer with the lid part open according to the first embodiment of the present invention.

FIG. 13 and FIG. 14 are a cross-sectional view and a rear-side perspective view, respectively, of the printer with the first rotating shaft 52 disengaged from the first engaging part 62.

As illustrated in FIG. 13 and FIG. 14, when the first rotating shaft 52 is disengaged from the first engaging part 62, the second rotating shaft 54 serves as a shaft for the opening and closing of the lid part 20 because the second rotating shaft 54 is rotatably and unremovably received by the bearing part 64 as described above. Further, since the second predetermined force f is absorbed from the externally-applied first predetermined force F as described above, a force applied to the bearing part 64 and the second rotating shaft 54 is smaller than the first predetermined force F. Accordingly, it is possible to prevent breakage of the bearing part 64 and the second rotating shaft 54. Then, the lid part 20 is caused to rotate on the second rotating shaft 54.

Thus, according to the printer of this embodiment, when an operator opens the lid part 20 with an excessive force (fifth predetermined force), the first predetermined force F is applied to the first rotating shaft 52 in a direction for the first rotating shaft 52 to be removed from the first engaging part 62. Further, when the first rotating shaft 52 is removed from the first engaging part 62, the second predetermined force f is absorbed from the first predetermined force F. Accordingly, a force applied to the second rotating shaft 54 and the bearing part 64 is reduced so that the second rotating shaft 54 and the bearing part 64 are prevented from being damaged.

Therefore, the breakage of the first rotating shaft 52 and the first engaging part 62 is prevented, so that it is possible to prevent separation of the lid part 20 and the body part 40 and to prevent separation or breakage of the transmission part (FPC 50). Further, the engagement of the second rotating shaft 54 with the second engaging part 64 allows the lid part 20 to be opened and closed (relative to the body part 40), thus allowing the lid part 20 to serve an ordinary role of a lid for a printer.

[b] Second Embodiment

Figure 15:
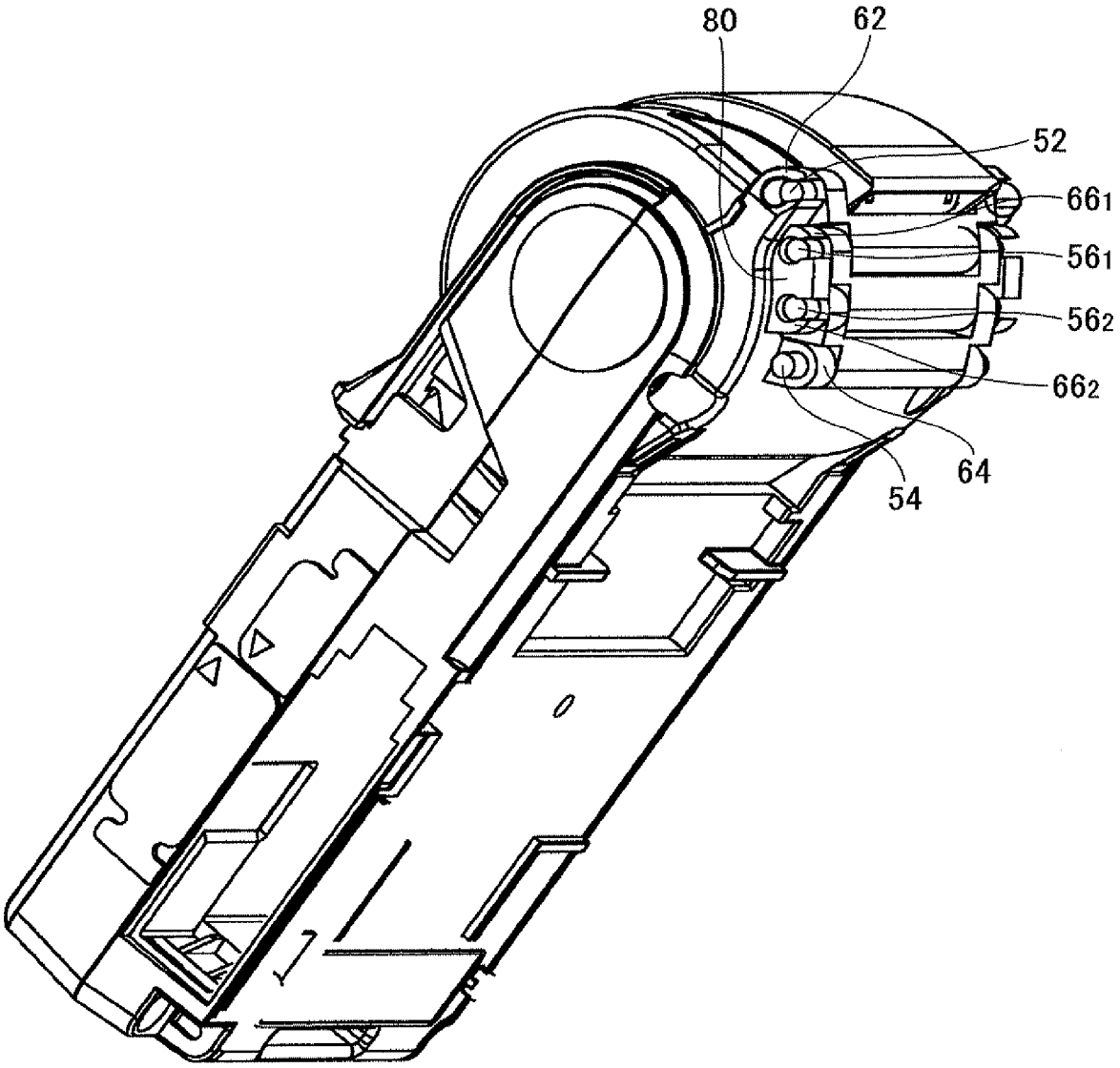
FIG. 15 is a rear-side perspective view of a printer with the lid part closed according to a second embodiment of the present invention.
Figure 16:
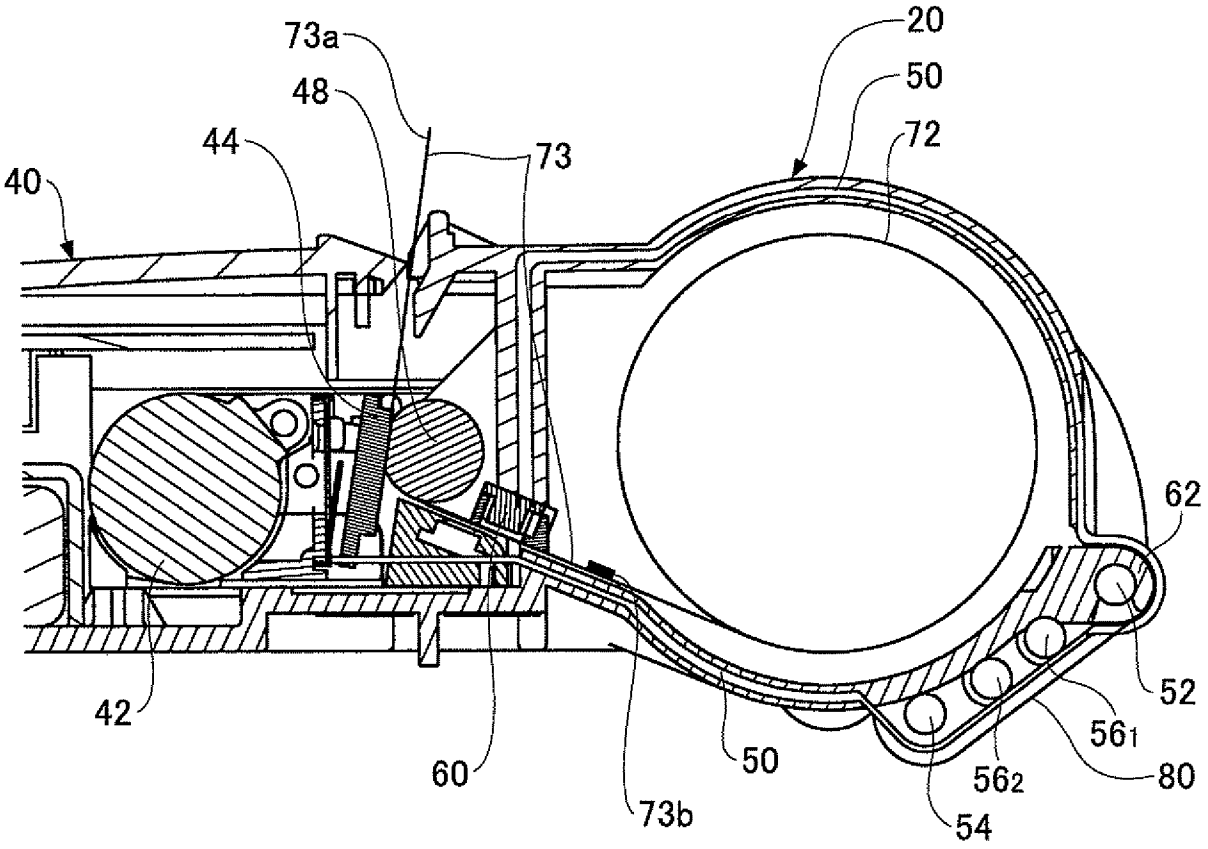
FIG. 16 is a cross-sectional view of the printer with the lid part closed according to the second embodiment of the present invention.

Next, a description is given of a printer according to a second embodiment. The printer of this embodiment with the lid part 20 closed may have the same front-side perspective view as FIG. 7. Further, FIG. 15 and FIG. 16 are a rear-side perspective view and a cross-sectional view, respectively, of the printer of this embodiment with the lid part 20 closed. In this embodiment, the same elements as those described above are referred to by the same reference characters or numerals, and a description thereof is omitted.

The printer described in the first embodiment has the single first rotating shaft 52 and the single second rotation shaft 54. The printer according to this embodiment has n third rotating shafts 56*n* (n=1, N) provided between the first rotating shaft 52 and the second rotating shaft 54.

Further, n third engaging parts 66*n* (n=1, . . . , N) are provided between the first engaging part 62 and the bearing part 64. The n third rotating shafts 56*n* (n=1, . . . , N) are engaged with the n third engaging parts 66*n* (n=1, . . . , N), respectively. In the following description, N is 2 (N=2), and the third rotating shafts $\mathbf{56}_1$ and $\mathbf{56}_2$ are disposed in this order in a direction from the first rotating shaft 52 to the second rotating shaft 54. The first rotating shaft 52, the third rotating shafts $\mathbf{56}_1$ and $\mathbf{56}_2$, and the second rotating shaft 54 are united through a junction member 80.

Further, as illustrated in FIG. 15, the first rotating shaft 52 is removably and rotatably engaged with the first engaging part 62. Further, the third rotating shafts $\mathbf{56}_1$ and $\mathbf{56}_2$ are removably and rotatably engaged with the third engaging parts $\mathbf{66}_1$ and $\mathbf{66}_2$, respectively. The configuration of engagement for the first rotating shaft 52 and the third rotating shafts $\mathbf{56}_1$ and $\mathbf{56}_2$ is the same as illustrated in FIGS. 12A and 12B, and accordingly, a description thereof is omitted. That is, when the first rotating shaft 52 and the third rotating shafts $\mathbf{56}_1$ and $\mathbf{56}_2$ are removed from the first engaging part 62 and the third engaging parts $\mathbf{66}_1$ and $\mathbf{66}_2$, respectively, a force to be described below is absorbed.

The printer of this embodiment includes multiple removable rotating shafts. Therefore, when an external force (a third predetermined force) is applied to the lid part 20 in a direction to open the lid part 20, a larger part of the external force is absorbed (than in the first embodiment). This absorbed force is defined as a fourth predetermined force. The fourth predetermined force is greater in value than the second predetermined force f (described in the first embodiment) (reason for which is to be described below). Further, the third predetermined force is greater than the first predetermined force F (described in the first embodiment).

First, a description is given of the case where no external force is applied (Case 1).

Figure 17:
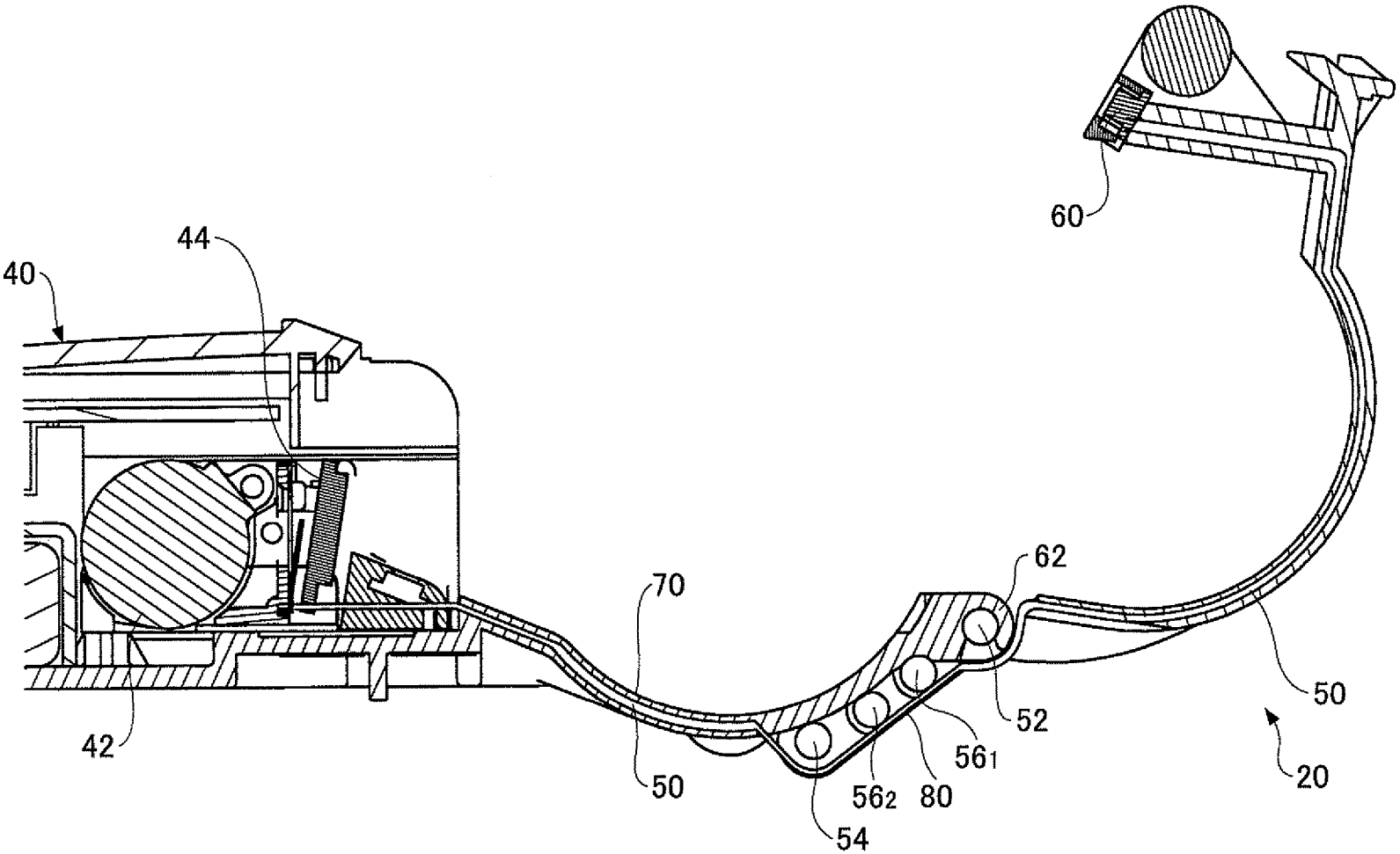
FIG. 17 is a cross-sectional view of the printer with the lid part open according to the second embodiment of the present invention.
Figure 18:
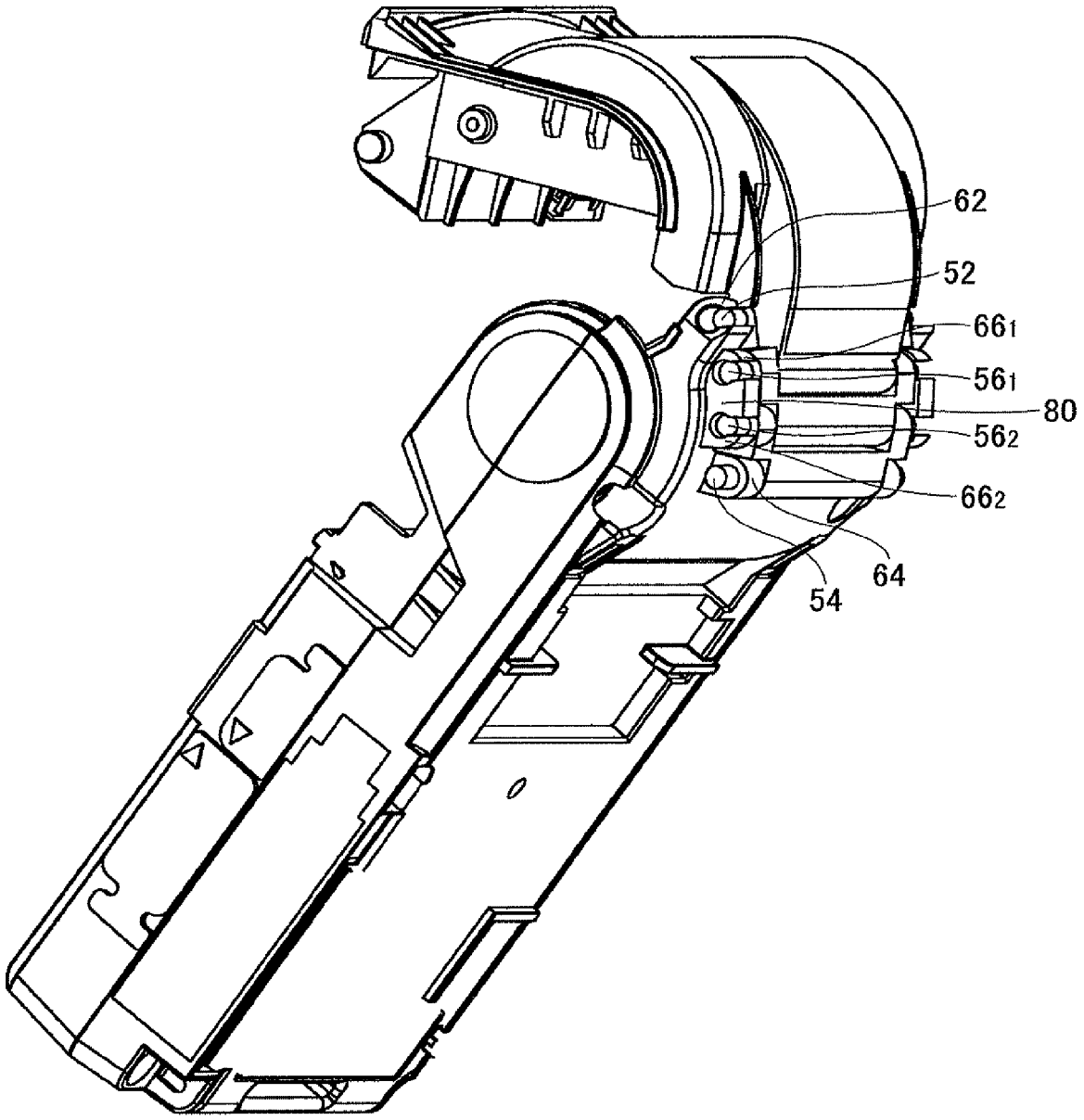
FIG. 18 is a rear-side perspective view of the printer with the lid part open according to the second embodiment of the present invention.

In this case, the first rotating shaft 52 is rotatably engaged with the first engaging part 62. Further, the lid part 20 is rotatable (openable and closable) on the first rotating shaft 52 relative to the body part 40. FIG. 17 and FIG. 18 are a cross-sectional view and a rear-side perspective view, respectively, of the printer with the lid part 20 rotated on the first rotating shaft 52 to be open relative to the body part 40. As illustrated in FIG. 17 and FIG. 18, the third rotating shafts $\mathbf{56}_1$ and $\mathbf{56}_2$ are engaged with the third engaging parts $\mathbf{66}_1$ and $\mathbf{66}_2$, respectively, and the third rotating shaft 54 is received by the bearing part 64.

A description is given below of the condition of the printer in cases where the predetermined third force is applied to the lid part 20, such as when a user opens the lid part 20 with an excessive force. The following description is given with the magnitude of the third predetermined force gradually varied with $F_1 \ldots <F_n \ldots <F_N$. In this embodiment, $F_1<F_2<F3<F_4$. Further, as described above, the third rotating shafts $\mathbf{56}_1$ and $\mathbf{56}_2$ (56*n* [n=1 to N]) are disposed in this order in the direction from the first rotating shaft 52 to the second rotating shaft 54. Therefore, the third rotating shafts $\mathbf{56}_1$ and $\mathbf{56}_2$ are successively removed from the third engaging parts $\mathbf{66}_1$ and $\mathbf{66}_2$ (66*n* [n=1 to N]) respectively, based on the magnitude of the third predetermined force.

A description is given of the case where a third predetermined force $F_1$ is externally applied (Case 2).

Figure 19:
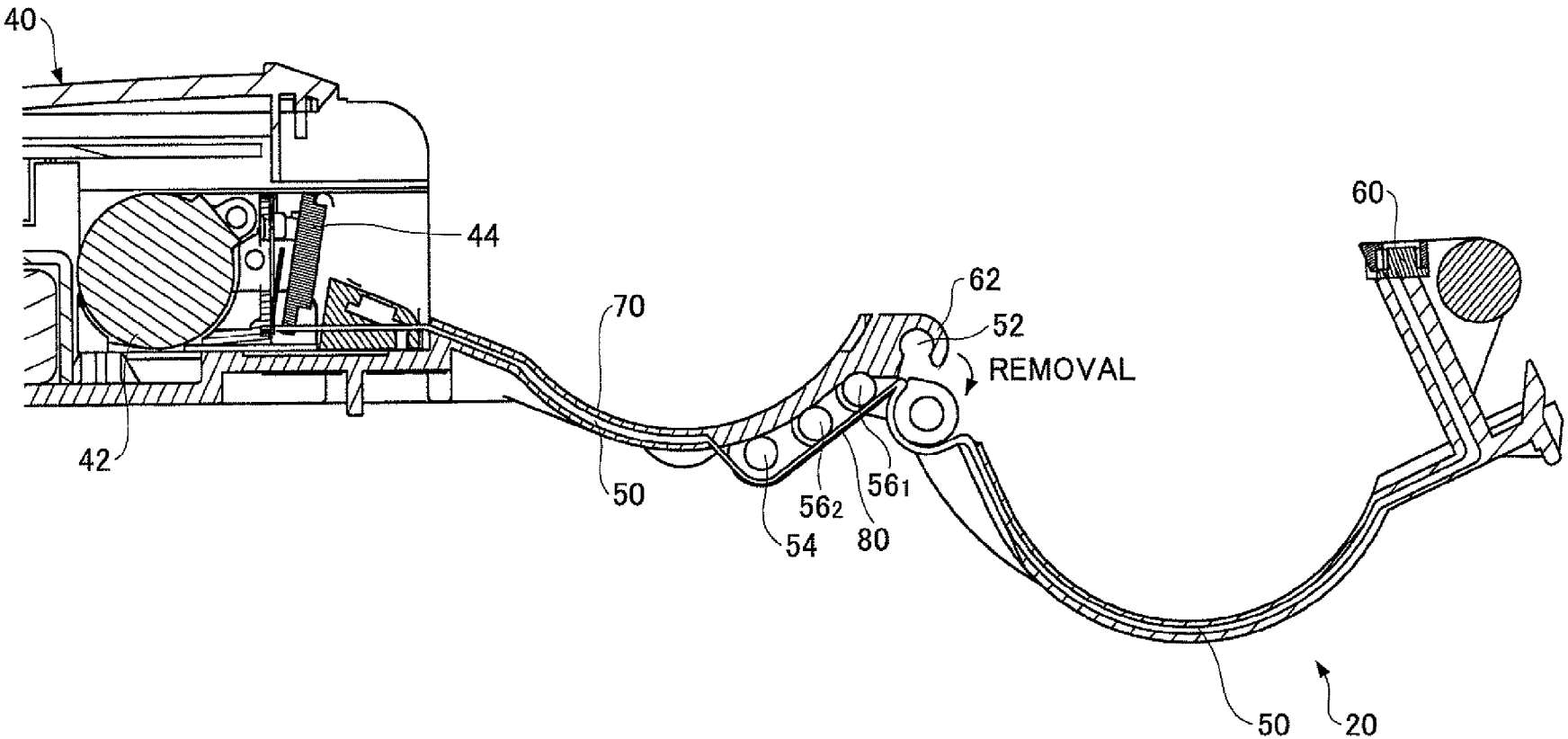
FIG. 19 is a cross-sectional view of the printer with the lid part open according to the second embodiment of the present invention.
Figure 20:
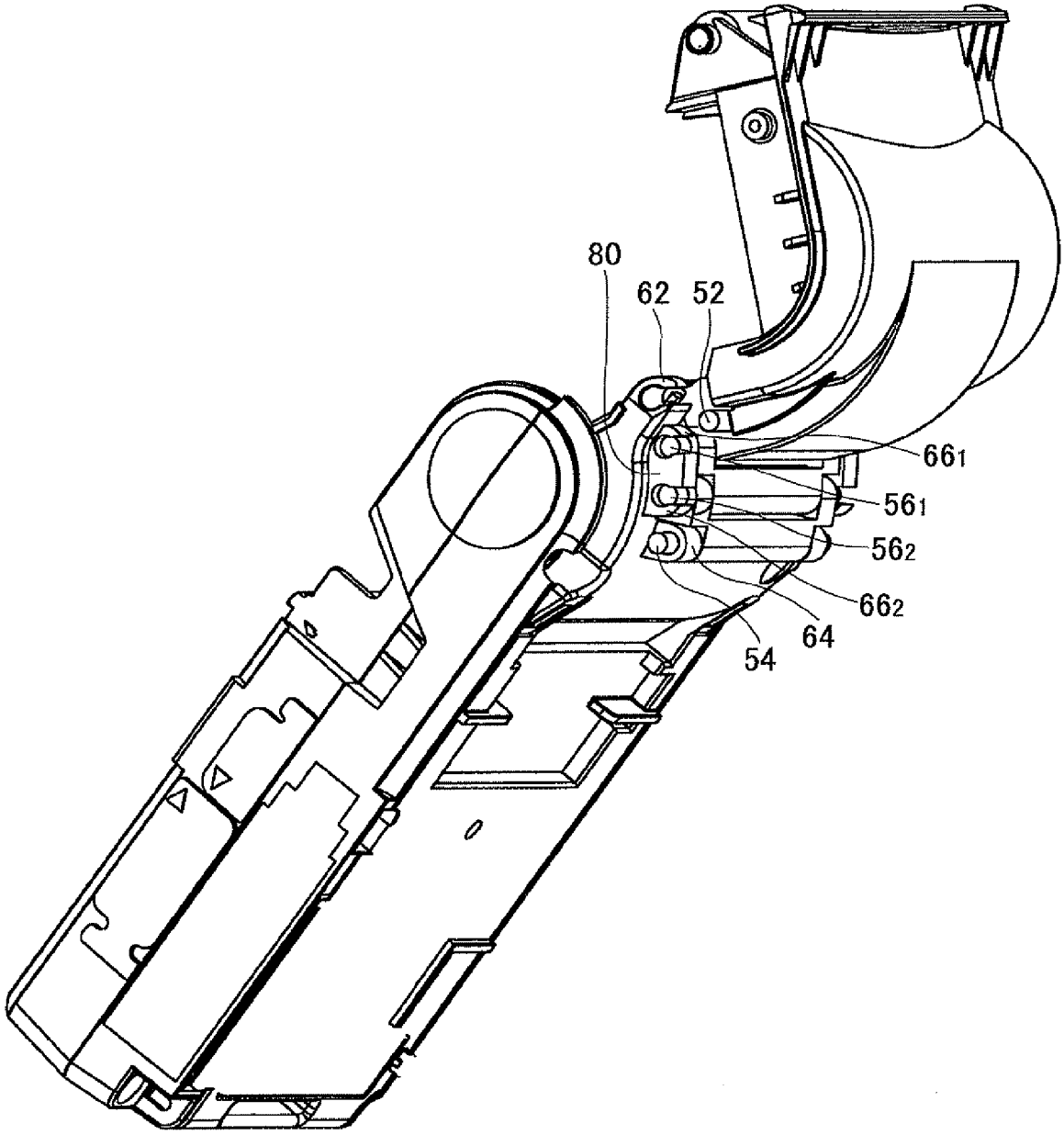
FIG. 20 is a rear-side perspective view of the printer with the lid part open according to the second embodiment of the present invention.

In this case, the operation is the same as illustrated in the first embodiment. FIG. 19 and FIG. 20 are a cross-sectional view and a rear-side perspective view, respectively, of the printer in this case. When the third predetermined force $F_1$ is externally applied to the lid part 20, the first rotating shaft 52 is removed from the first engaging part 62, while the third rotating shaft $\mathbf{56}_1$ remains engaged with (is not removed from) the third engaging part $\mathbf{66}_1$ as illustrated in FIG. 19. Further, when the first rotating shaft 52 is removed from the first engaging part 62, a second predetermined force $f_1$ is absorbed from the third predetermined force $F_1$. Then, the lid part 20 is allowed to rotate on the third rotating shaft $\mathbf{56}_1$ to be opened and closed relative to the body part 40. That is, the third predetermined force $F_1$ is of such magnitude as to cause the first rotating shaft 52 to be removed from the first engaging part 62 without causing the third rotating shaft $\mathbf{56}_1$ to be removed from the third engaging part $\mathbf{66}_1$.

Next, a description is given of the case where a third predetermined force $F_2$ is externally applied (Case 3).

Figure 21:
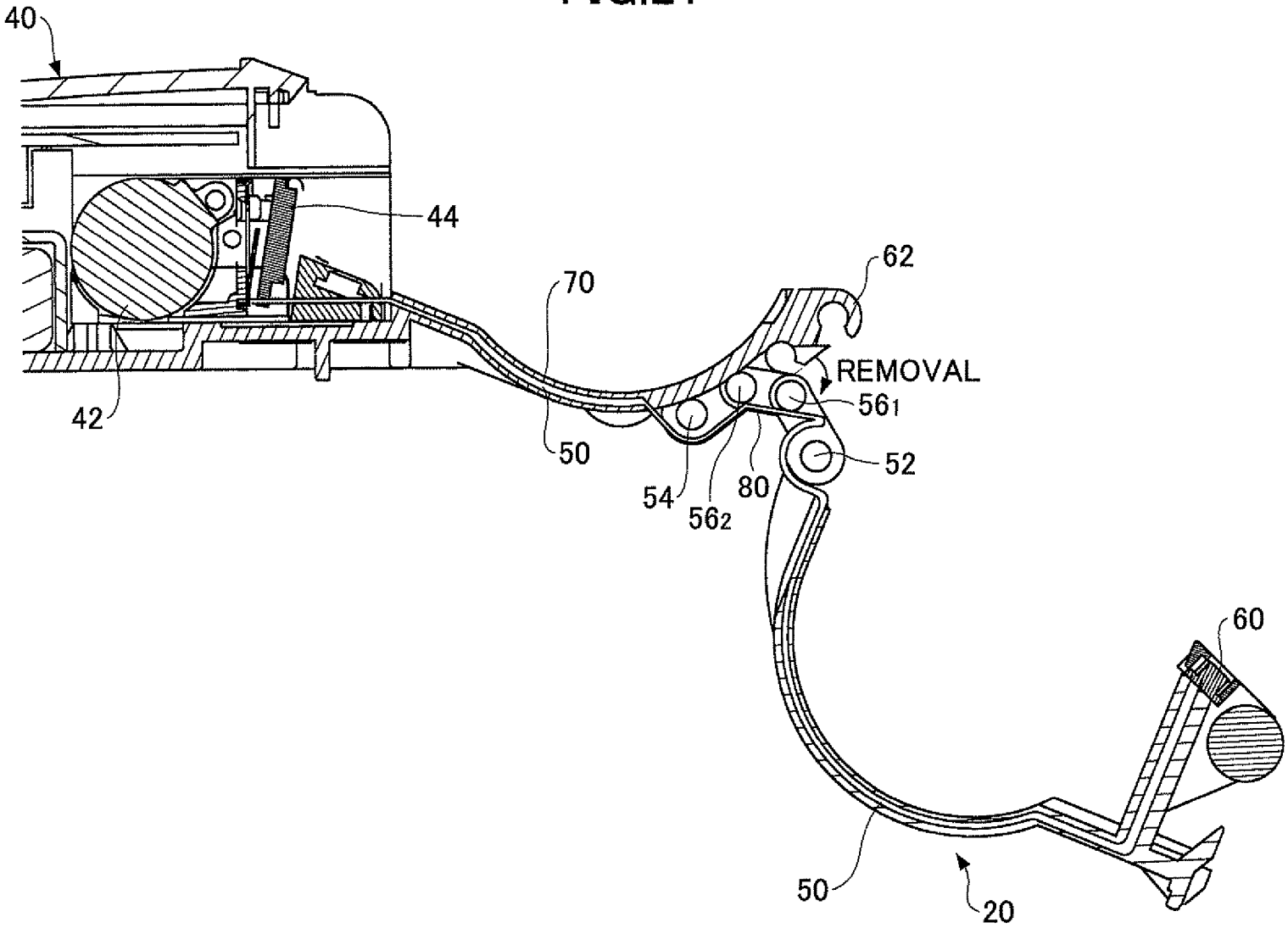
FIG. 21 is a cross-sectional view of the printer with the lid part open according to the second embodiment of the present invention.
Figure 22:
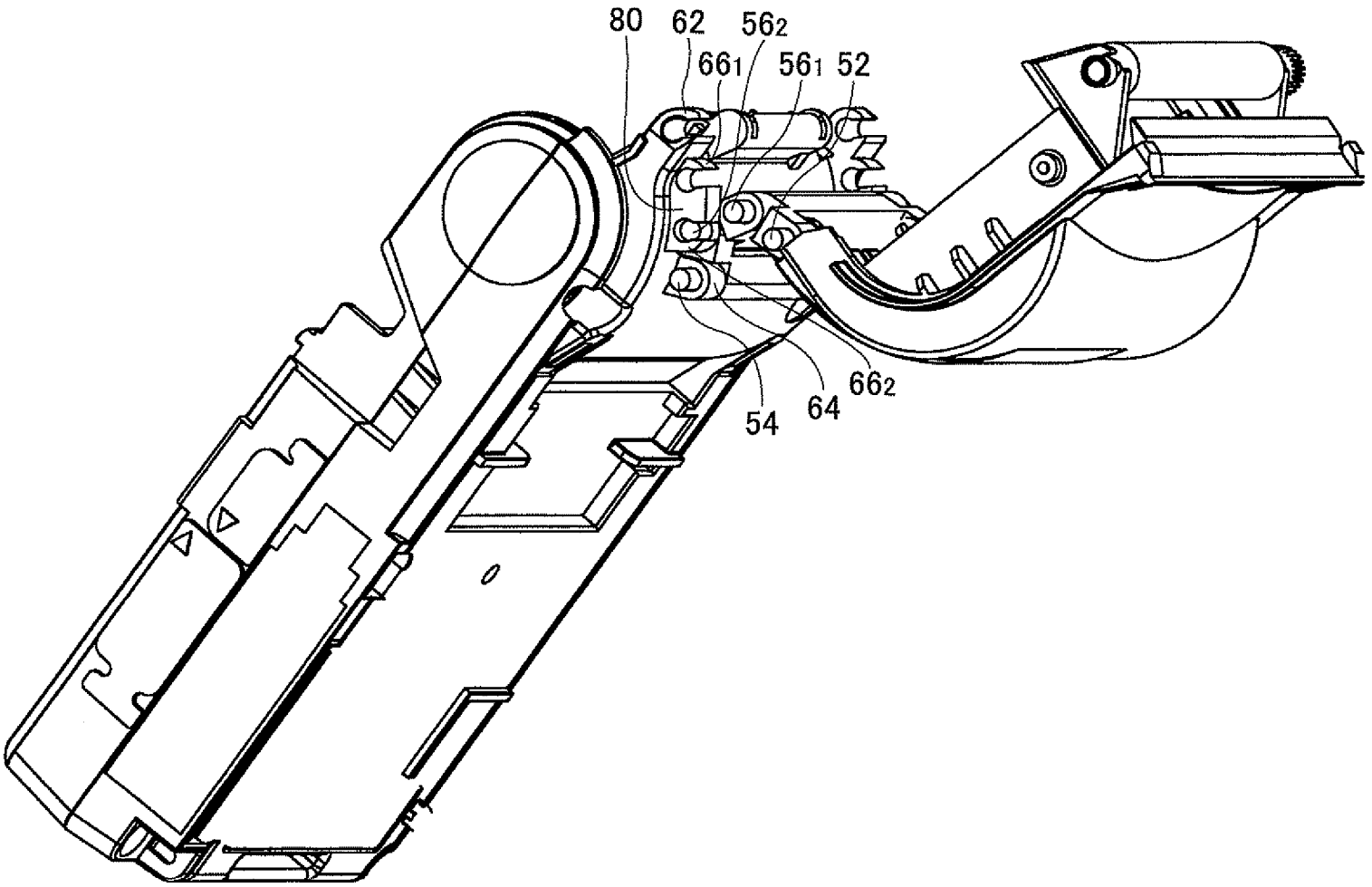
FIG. 22 is a rear-side perspective view of the printer with the lid part open according to the second embodiment of the present invention.

FIG. 21 and FIG. 22 are a cross-sectional view and a rear-side perspective view, respectively, of the printer in this case. When the third predetermined force $F_2$ is externally applied to the lid part 20, the first rotating shaft 52 is removed from the first engaging part 62 and the third rotating shaft $\mathbf{56}_1$ is removed from the third engaging part $\mathbf{66}_1$, while the third rotating shaft $\mathbf{56}_2$ remains engaged with (is not removed from) the third engaging part $\mathbf{66}_2$ as illustrated in FIG. 21.

Further, when the first rotating shaft 52 is removed from the first engaging part 62, the second predetermined force $f_1$ is absorbed from the third predetermined force $F_2$, and when the third rotating shaft $\mathbf{56}_1$ is removed from the third engaging part $\mathbf{66}_1$, a second predetermined force $f_2$ is absorbed from the third predetermined force $F_2$. That is, the second predetermined force $f_1$ and the second predetermined force $f_2$ are absorbed from the third predetermined force $F_2$ ($F_2-(f_1+f_2)$). Here, the fourth predetermined force is $f_1+f_2$. That is, the fourth predetermined force is greater than the second predetermined force f (=$f_1$) described in the first embodiment. Then, the lid part 20 is allowed to rotate on the third rotating shaft $\mathbf{56}_2$ to be opened and closed relative to the body part 40.

Next, a description is given of the case where a third predetermined force $F_3$ is externally applied (Case 4).

Figure 23:
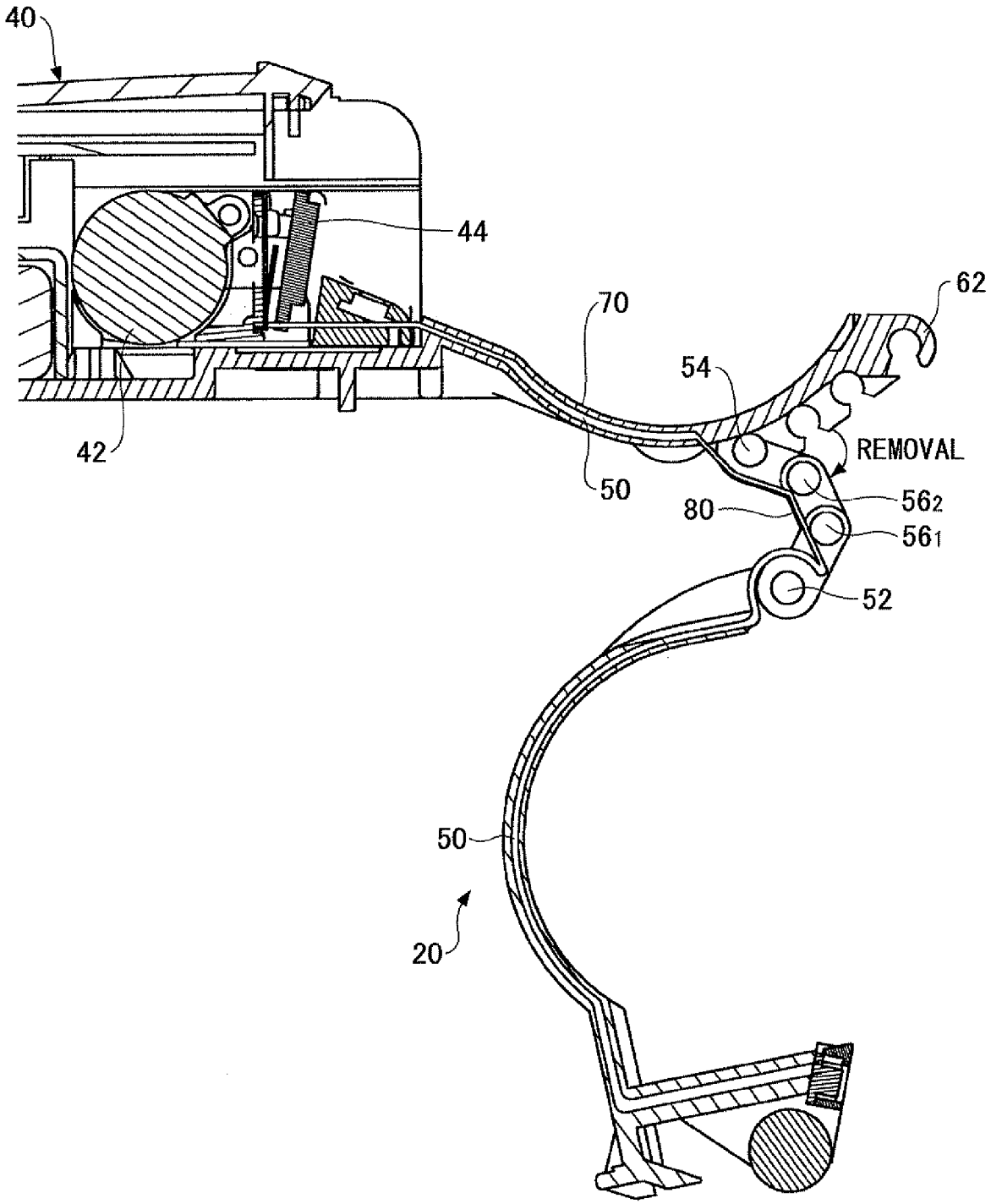
FIG. 23 is a cross-sectional view of the printer with the lid part open according to the second embodiment of the present invention.
Figure 24:
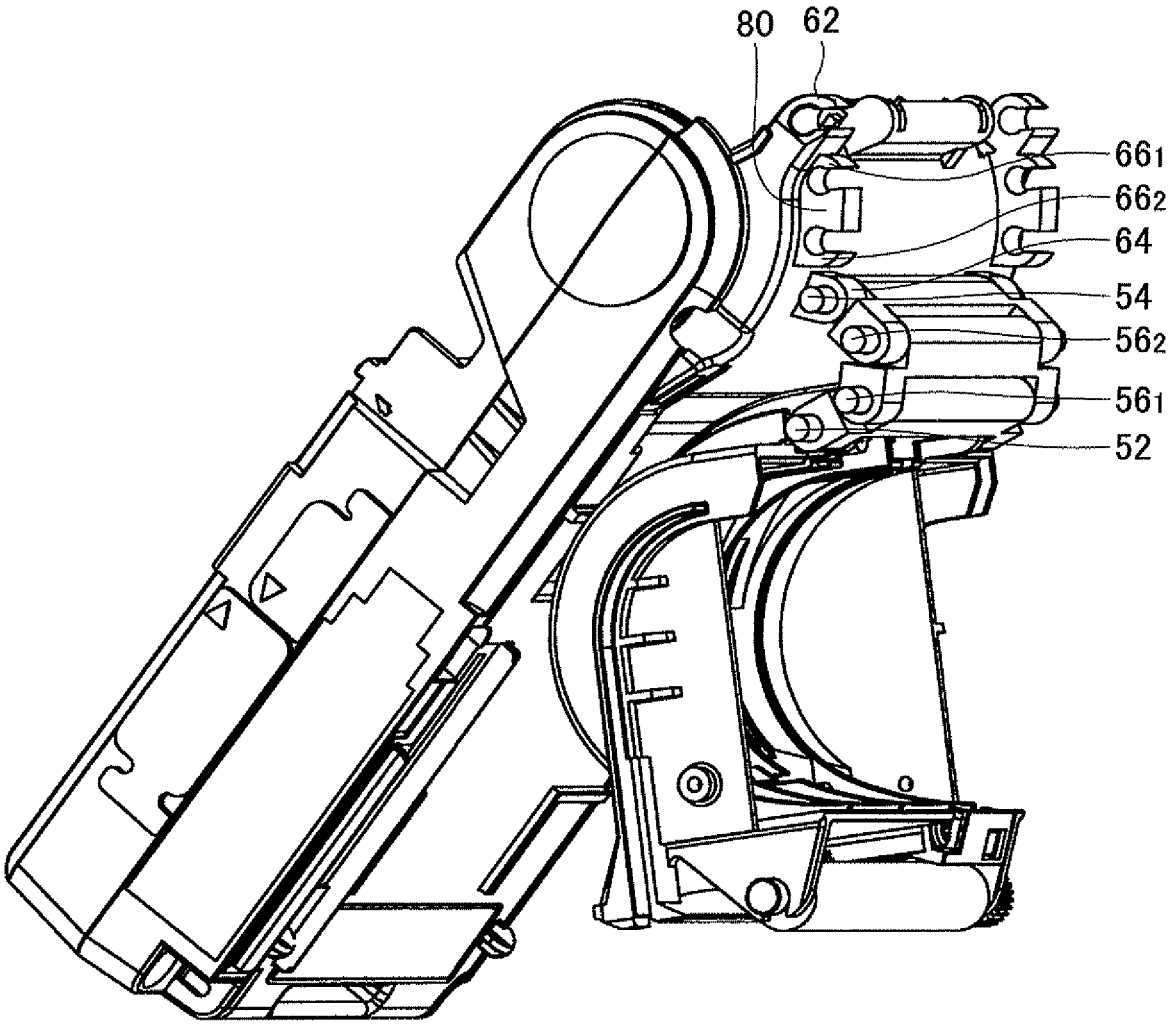
FIG. 24 is a rear-side perspective view of the printer with the lid part open according to the second embodiment of the present invention.

FIG. 23 and FIG. 24 are a cross-sectional view and a rear-side perspective view, respectively, of the printer in this case. When the third predetermined force $F_3$ is externally applied to the lid part 20, the first rotating shaft 52 is removed from the first engaging part 62 and the third rotating shafts $\mathbf{56}_1$ and $\mathbf{56}_2$ are removed from the third engaging parts $\mathbf{66}_1$ and $\mathbf{66}_2$, respectively, as illustrated in FIG. 23. Further, when the first rotating shaft 52, the third rotating shaft $\mathbf{56}_1$, and the third rotating shaft $\mathbf{56}_2$ are removed from the first engaging part 62, the third engaging part $\mathbf{66}_1$, and the third engaging part $\mathbf{66}_2$, the second predetermined force $f_1$, the second predetermined force $f_2$, and a second predetermined force $f_3$, respectively, are absorbed. That is, the fourth predetermined force ($f_1+f_2+f_3$) is absorbed. Further, as described above, the third rotating shaft 54 is unremovably received by the bearing part 64. Accordingly, the lid part 20 is rotatable on the third rotating shaft 54 relative to the body part 40.

Next, a description is given of the case where the printer includes N third rotating shafts and N third engaging parts.

In relation to the following description, the second predetermined forces absorbed when the first rotating shaft 52 and the third rotating shafts 56*n* are removed from their respective engaging parts 62 and 66*n* are illustrated below.

| Remove rotating shaft | Absorbed second predetermined force |
|---|---|
| First rotating shaft 52 | . . . $f_1$ |
| Third rotating shaft $56_1$ | . . . $f_2$ |
| Third rotating shaft $56_2$ | . . . $f_3$ |
| . | |
| . | |
| . | |
| Third rotating shaft $56_n$ | . . . $f_{n+1}$ |
| Third rotating shaft $56_{n+1}$ | . . . $f_{n+2}$ |
| . | |
| . | |
| . | |
| Third rotating shaft $56_{N-1}$ | . . . $f_N$ |
| Third rotating shaft $56_N$ | . . . $f_{N+1}$ |

If the third predetermined force $F_1$ is applied to the printer, the first rotating shaft 52 is removed from the first engaging part 62, while the third rotating shaft $\mathbf{56}_1$ remains engaged with the third engaging part $\mathbf{66}_1$ as described above in Case 1. Further, at the time of removal of the first rotating shaft 52, the force $f_1$ is absorbed from the third predetermined force $F_1$ as the fourth predetermined force. Then, the lid part 20 is rotatable on the third rotating shaft $\mathbf{56}_1$ to be opened and closed relative to the body part 40.

Further, if a predetermined force Fn (n=1, . . . , N−1) is applied to the printer (as described above in Cases 2 and 3), the first rotating shaft 52 is removed from the first engaging part 62, and the third rotating shafts $\mathbf{56}_1$ through $\mathbf{56}_n$ are removed from the third engaging parts $\mathbf{66}_1$ through $\mathbf{66}_n$, respectively. At the time of removal of the first rotating shaft 52 and the third rotating shafts $\mathbf{56}_1$ through $\mathbf{56}_n$, the fourth predetermined force is $f_1$ (a force absorbed at the time of removal of the first rotating shaft 52)+($f_2$+$f_3$+ . . . +$f_n$+$f_{n+1}$) (forces absorbed at the time of removal of the third rotating shafts $\mathbf{56}_1$ through $\mathbf{56}_n$).

Since the third rotating shaft $\mathbf{56}_{n+1}$ is engaged with the third engaging part $\mathbf{66}_{n+1}$, the lid part 20 is allowed to rotate on the third rotating shaft $\mathbf{56}_{n+1}$ to be opened and closed relative to the body part 40.

Further, if a predetermined force $F_N$ is applied to the printer (as described above in Case 4), the first rotating shaft 52 is removed from the first engaging part 62, and all of the third rotating shafts $\mathbf{56}_1$ through $\mathbf{56}_N$ are removed from the third engaging parts $\mathbf{66}_1$ through $\mathbf{66}_N$, respectively. At the time of removal of the first rotating shaft 52 and the third rotating shafts $\mathbf{56}_1$ through $\mathbf{56}_N$, the fourth predetermined force is $f_1$ (a force absorbed at the time of removal of the first rotating shaft 52)+($f_2$+$f_3$+ . . . +$f_N$+$f_{N+1}$) (forces absorbed at the time of removal of all of the third rotating shafts $\mathbf{56}_1$ through $\mathbf{56}_N$).

Since the second rotating shaft 54 remains received by the bearing part 64, the lid part 20 is allowed to rotate on the second rotating shaft 54 relative to the body part 40.

Thus, the printer according to this embodiment includes the removable first rotating shaft 52 and the N removable third rotating shafts $\mathbf{56}_n$ (n=1, . . . , N). At the time of removal of these N+1 rotating shafts, it is possible to absorb up to $f_1$+$f_2$+$f_3$+ . . . +$f_N$+$f_{N+1}$ as the fourth predetermined force. Accordingly, the printer of this embodiment is allowed to absorb more force (the fourth predetermined force) from the externally-applied third predetermined force.

[c] Third Embodiment

Next, a description is given of a printer according to a third embodiment.

In the following description, the same elements as those described above are referred to by the same reference characters or numerals, and a description thereof is omitted.

Figure 25:
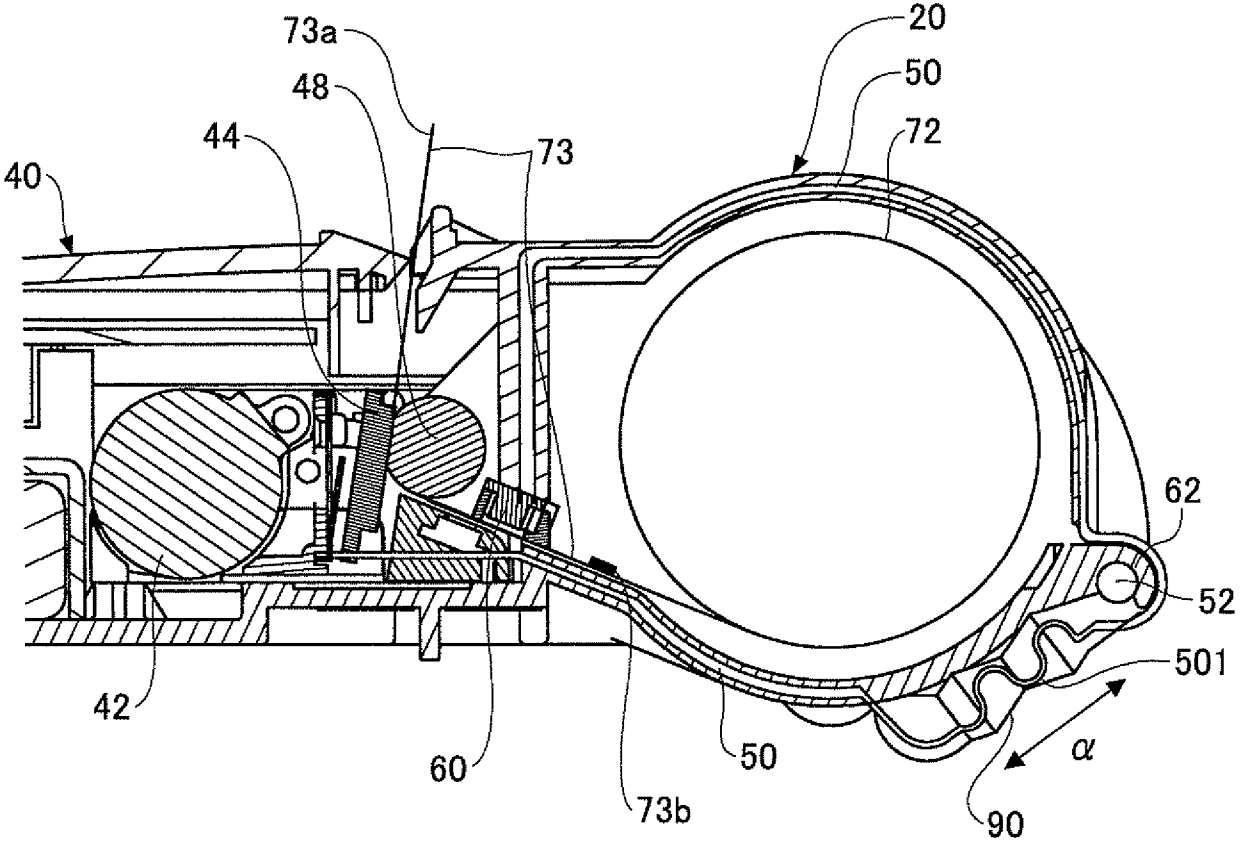
FIG. 25 is a cross-sectional view of a printer according to a third embodiment of the present invention.

FIG. 25 is a cross-sectional view of the printer according to this embodiment. FIG. 25 illustrates a case where the lid part 20 is closed. The printer illustrated in FIG. 25 is different from the printer illustrated in FIG. 9 in that the second rotating shaft 54 and the bearing part 64 are omitted, the FPC 50 (transmission part) includes a slack part 501, and part of the FPC 50 including the slack part 501 is housed in a housing part 90.

In the case illustrated in FIG. 25, the first rotating shaft 52 is removably engaged with the first engaging part 62 (as illustrated in FIGS. 12A and 12B). Alternatively, the first rotating shaft 52 may be unremovably received by a bearing part.

As illustrated in FIG. 25, the FPC 50 includes the slack part 501 near the first rotating shaft 52. That is, the FPC 50 is slack near the first rotating shaft 52. Further, the slack part 501 is extendable and contractible in the directions of arrow α (that is, in the directions in which the FPC 50 is provided). Further, the part of the FPC 50 that includes the slack part 501 is housed in the housing part 90. The housing part 90 has, for example, a bellows shape, and is configured to be extended and contracted along the extension/contraction directions α of the slack part 501. That is, both the slack part 501 and the housing part 90 are configured to be extended and contracted in the directions of arrow α. Further, letting the length of the fully-extended slack part 501 of the FPC 50 and the length of the fully-extended housing part 90 be L1 and L2, respectively, L1 is greater than or equal to L2 (L1≤L2).

Figure 26:
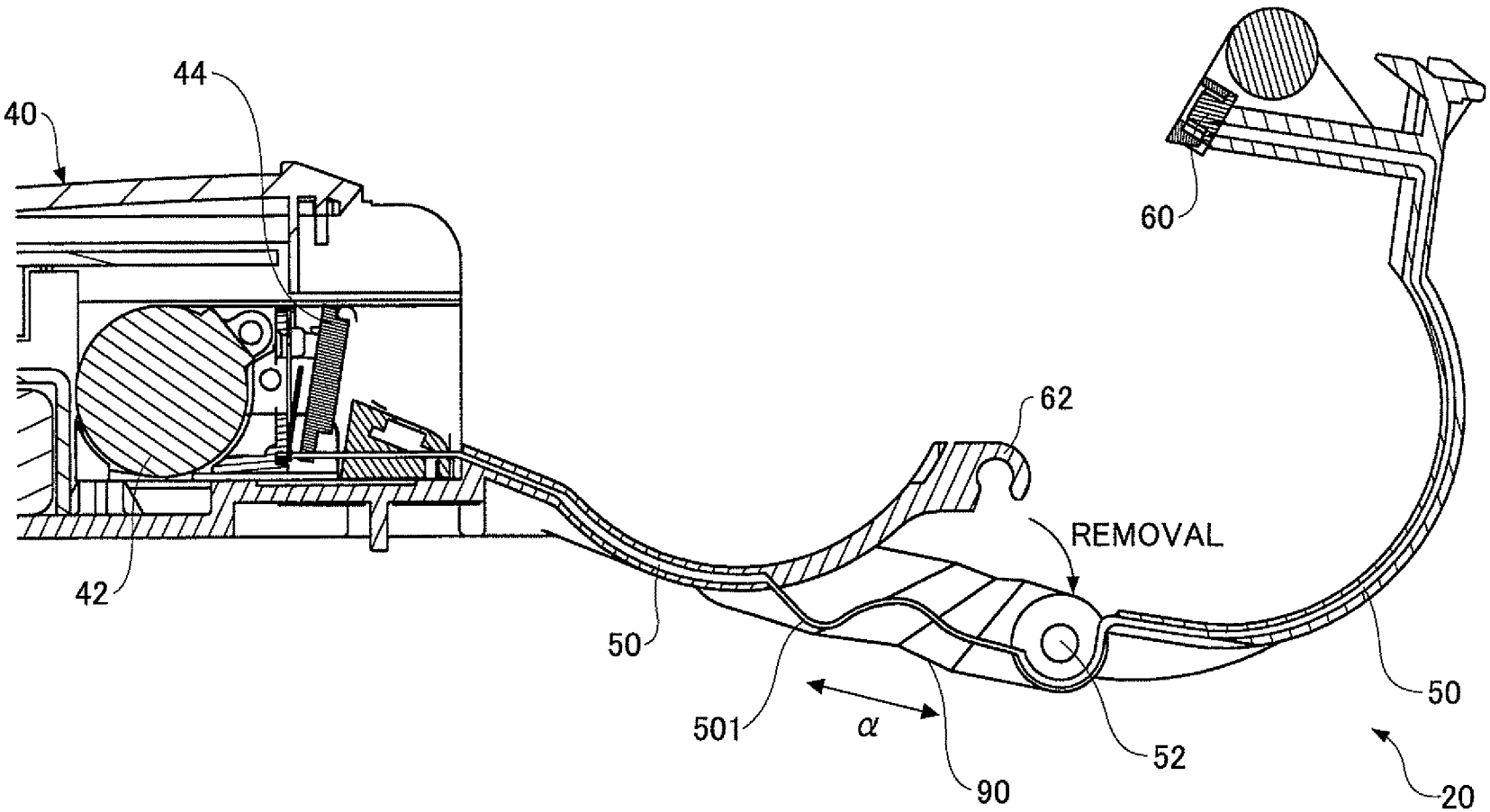
FIG. 26 is a cross-sectional view of the printer with the lid part open according to the third embodiment of the present invention.

FIG. 26 is a cross-sectional view of the printer in the case where an operator opens the lid part 20 with an excessive force so that the first rotating shaft 52 is removed from the first engaging part 62. In this case, since the FPC 50 includes the slack part 501, the slack part 501 extends in the directions of arrow α. With this, the housing part 90 also extends in the directions of arrow α. Since L1≥L2, the FPC 50 is still slightly slack or fully extended when the housing part 90 is fully extended.

Thus, according to the printer of the third embodiment, even if the lid part 20 and the body part 40 are separated because of application of an excessive force, the slack part 501 of the FPC 50 and the housing part 90 extend to prevent the FPC 50 from being severed or broken.

Thus, according to the third embodiment, even if the lid part 20 and the body part 40 are separated when a user opens the lid part 20 with an excessive force, it is possible to prevent the FPC (transmission part) from being severed or broken.

[d] Fourth Embodiment

Next, a description is given of a printer according to a fourth embodiment.

Figure 27:
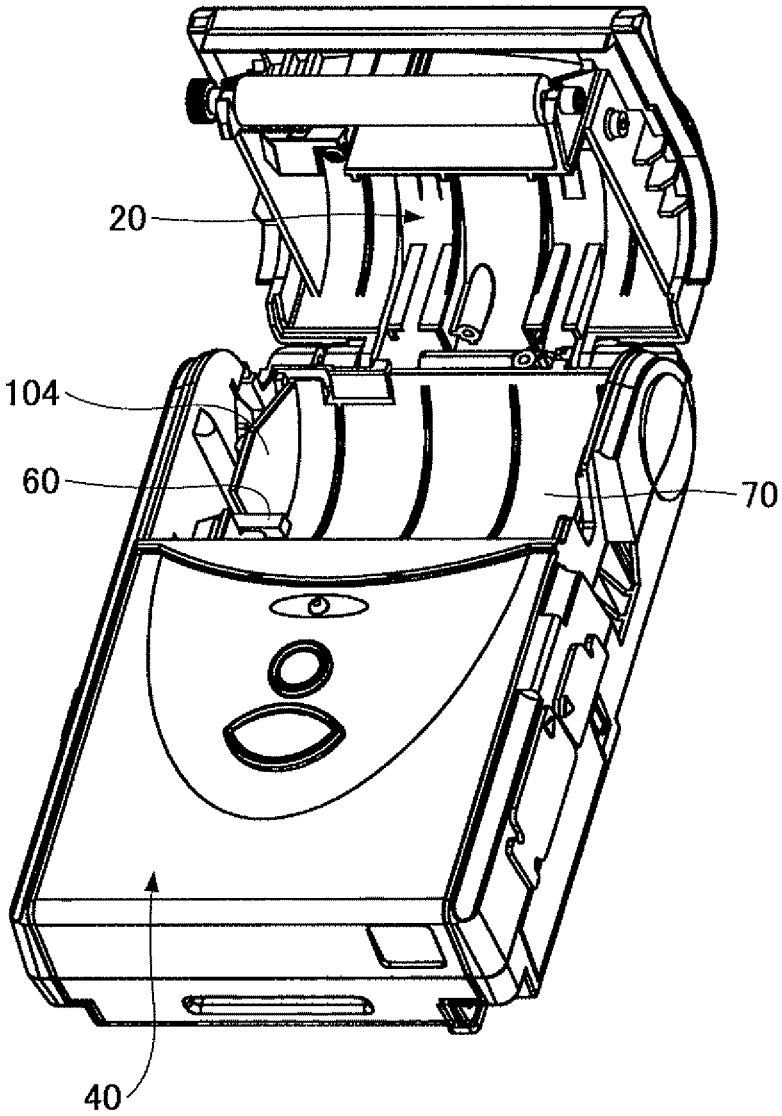
FIG. 27 is a perspective view of a printer with the lid part open according to a fourth embodiment of the present invention.
Figure 28:
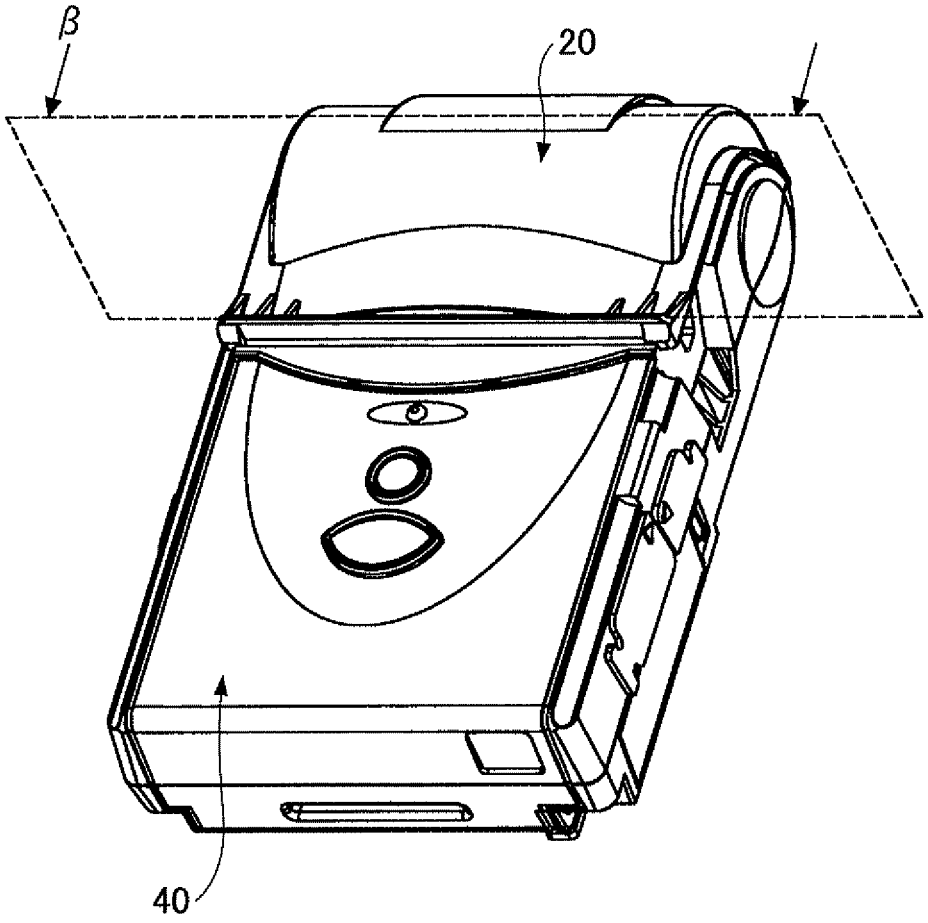
FIG. 28 is a perspective view of the printer with the lid part closed according to the fourth embodiment of the present invention.
Figure 29:
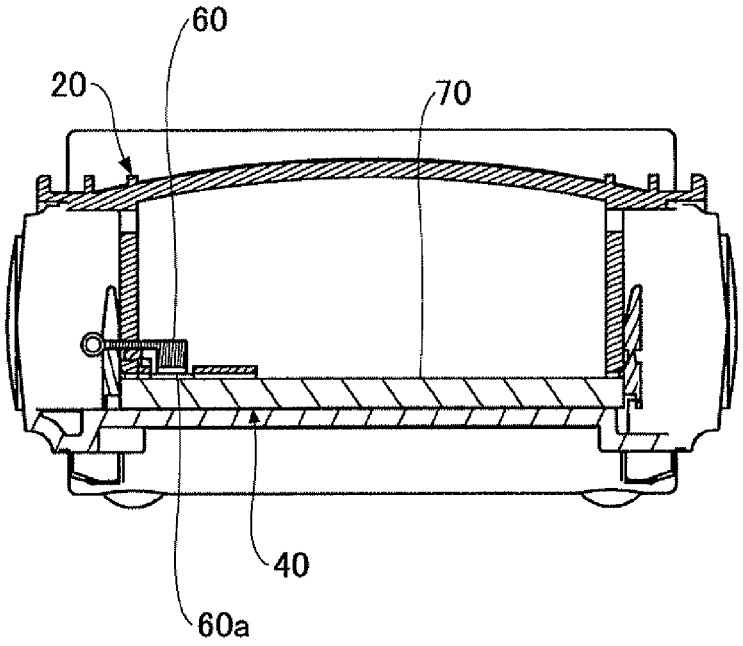
FIG. 29 is a cross-sectional view of the printer with the lid part closed according to the fourth embodiment of the present invention, taken along plane β indicated by broken line in FIG. 28.

FIG. 27 is a perspective view of the printer of this embodiment in the case of providing the mark detecting part 60 in the body part 40 with the lid part 20 open. FIG. 28 is a perspective view of the printer of this embodiment with the lid part 20 closed. FIG. 29 is a cross-sectional view of the printer of this embodiment with the lid part 20 closed, taken along plane β indicated by a broken line in FIG. 28.

According to this embodiment, the lid part 20 and the body part 40 may be engaged with each other with multiple rotating shafts and multiple engaging parts as in the above-described first and second embodiments, or with a single rotating shaft and a single engaging part as in the above-described third embodiment.

As illustrated in FIG. 29, the mark detecting part 60 is disposed so that a mark reading surface 60*a* of the mark detecting part 60 faces the conveyance path of the paper 73 (FIG. 9) (hereinafter referred to as "paper conveyance path") with the lid part 20 closed. This position where the mark reading surface 60*a* faces the paper conveyance path, that is, the position where the mark detecting part 60 is allowed to detect the mark 73*b* (FIG. 9) added to the reverse side of the paper 73, is referred to as "detection-enabled position." That is, in the state of FIG. 29, the mark detecting part 60 is positioned at the detection-enabled position.

Further, the printer of this embodiment includes a moving part. A path through which the paper roll 72 (FIG. 9) held by an operator is completely housed (set) into the paper roll housing part 70 when the operator loads the paper roll housing part 70 with the paper roll 72 is referred to as "paper housing path." That is, at the time of setting a new paper roll, the operator has the new paper roll housed into the paper roll housing part 70 via the paper housing path.

Figure 30:
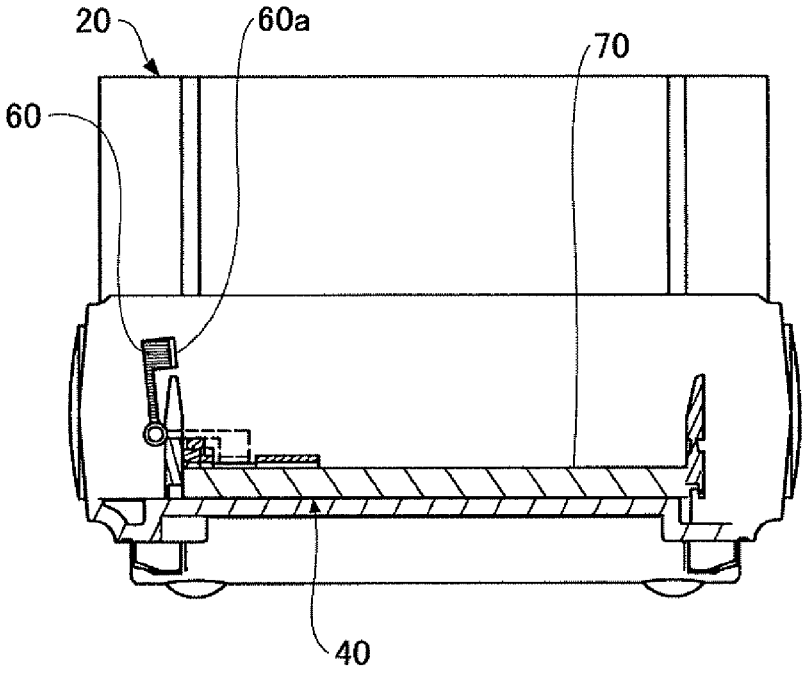
FIG. 30 is a cross-sectional view of the printer with lid part open according to the fourth embodiment of the present invention.

Then, as illustrated in FIG. 30, when the lid part 20 is opened, the moving part causes the mark detecting part 60 positioned at the detection-enabled position to move outside the paper housing path. That is, there is no component in the paper housing path, so that there is no hindrance to housing the paper roll 72. Accordingly, when opening the lid part 20, it is easy for an operator to load the paper roll housing part 70 with the paper roll 72.

Figure 31:
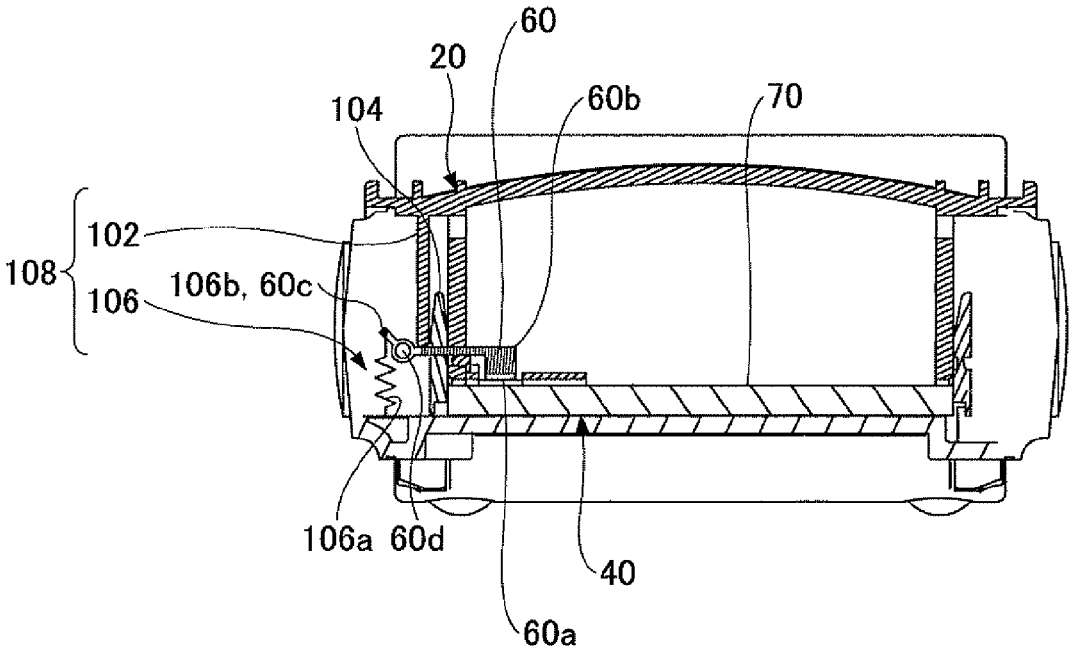
FIG. 31 is a cross-sectional view of the printer with the lid part closed according to the fourth embodiment of the present invention.
Figure 32:
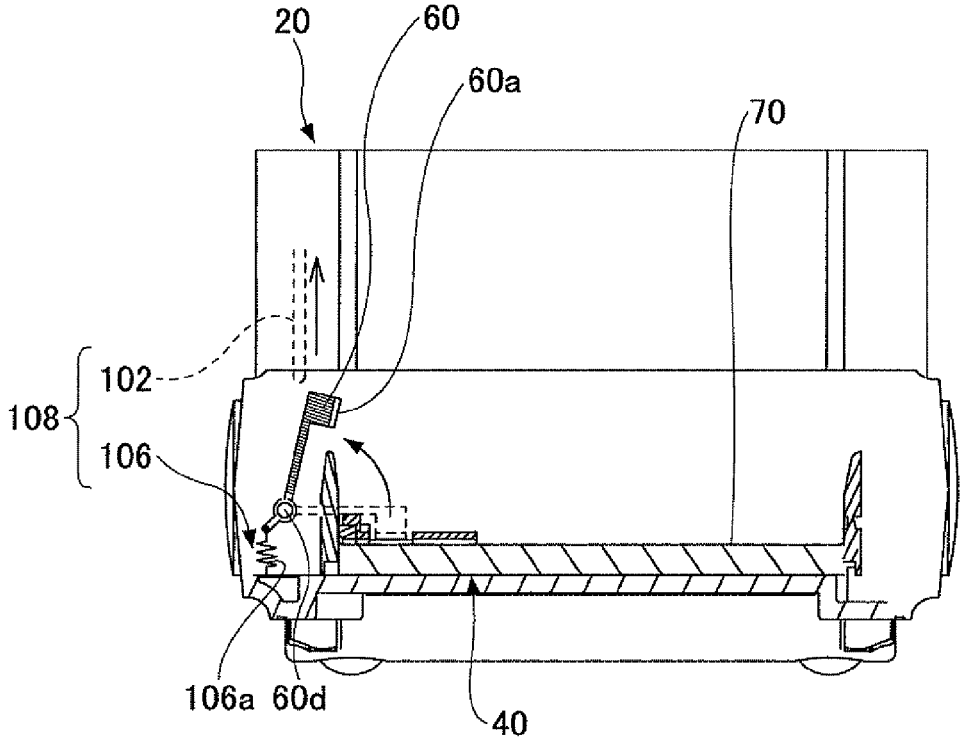
FIG. 32 is a cross-sectional view of the printer with the lid part open according to the fourth embodiment of the present invention.

Next, a description is given of an example of the moving part. FIG. 31 and FIG. 32 are diagrams illustrating a moving part 108. There are various configurations for the moving part 108. According to this embodiment, the moving part 108 includes an urging part 106 and a holding part 102. Examples of the urging part 106 include a spring. In the following description, the urging part 106 is described as a spring, but may be anything that has an urging force.

FIG. 31 is a cross-sectional view of the printer of this embodiment with the lid part 20 closed. FIG. 32 is a cross-sectional view of the printer of this embodiment with the lid part 20 open.

First, a description is given, using FIG. 31, of the mark detecting part 60. As illustrated in FIG. 31, the mark detecting part 60 has, for example, a substantially dogleg shape with bending. However, the mark detecting part 60 is not necessarily bent, and may be rectilinear in shape. The mark detecting part 60 includes an intermediate portion 60*d*, where the mark detecting part 60 is bent. The intermediate portion 60*d* serves as a shaft support part, and is rotatably supported. The mark detecting part 60 includes a first free end 60*b* and a second free end 60*c* to be rotatable on the intermediate portion (shaft support part) 60*d*.

The first free end 60*b* of the mark detecting part 60 includes the mark reading surface 60*a*. Further, the urging part (spring) 106 has a first end 106*a* provided on the body part 40 and a second end 106*b* connected to the second free end 60*c* of the mark detecting part 60. The urging part 106 urges the second free end 60*c* in an upward direction. This upward direction is a direction to move the mark detecting part 60 out of the paper housing path.

On the other hand, the holding part 102 is formed as a unit with the lid part 20. In this example, the holding part 102 has a rod shape and is formed to project from the inner surface of the lid part 20. Further, the holding part 102 is provided on the outer side of a wall part 104, which is a sidewall of the paper housing part 70. The holding part 102 is configured to move (hold) the mark detecting part 60 to the detection-enabled position against the urging of the urging part 106 when the lid part 20 is closed. In the case of FIG. 31, the holding part 102 causes the mark detecting part 60 to be at the detection-enabled position by pressing part of the mark detecting part 60 near the intermediate portion 60*d* on its mark reading surface 60*a* side. In the case of FIG. 31, the pressing direction of the holding part 102 is a downward direction.

Next, a description is given, using FIG. 32, of the case where the lid part 20 is open. When the lid part 20 is opened by a user, the holding part 102 moves upward together with the lid part 20. Therefore, the holding part 102 no longer presses the mark detecting part 60. Then, the mark detecting part 60 has its first free end 60*d* (the mark reading surface 60*a*) rotated upward by the urging of the urging part 106, so that the mark detecting part 60 is moved outside the paper housing path.

As a result of using this moving part 108, the mark detecting part 60 is moved to the detection-enabled position when the lid part 20 is closed, and is moved outside the paper housing path when the lid part 20 is open.

According to the printer of this embodiment, it is possible to cause the mark detecting part 60 to be moved outside the paper housing path by the moving part when the lid part 20 is opened. Accordingly, it is possible for an operator to smoothly load the paper roll housing part 70 with the paper roll 72.

Thus, according to the printer of this embodiment, it is possible to make it easy for an operator to load the paper roll housing part 70 with the paper roll 72 even in the case where the mark detecting part 60 is provided in the body part 40.

[e] Fifth Embodiment

Next, a description is given of a printer according to a fifth embodiment.

Figure 33:
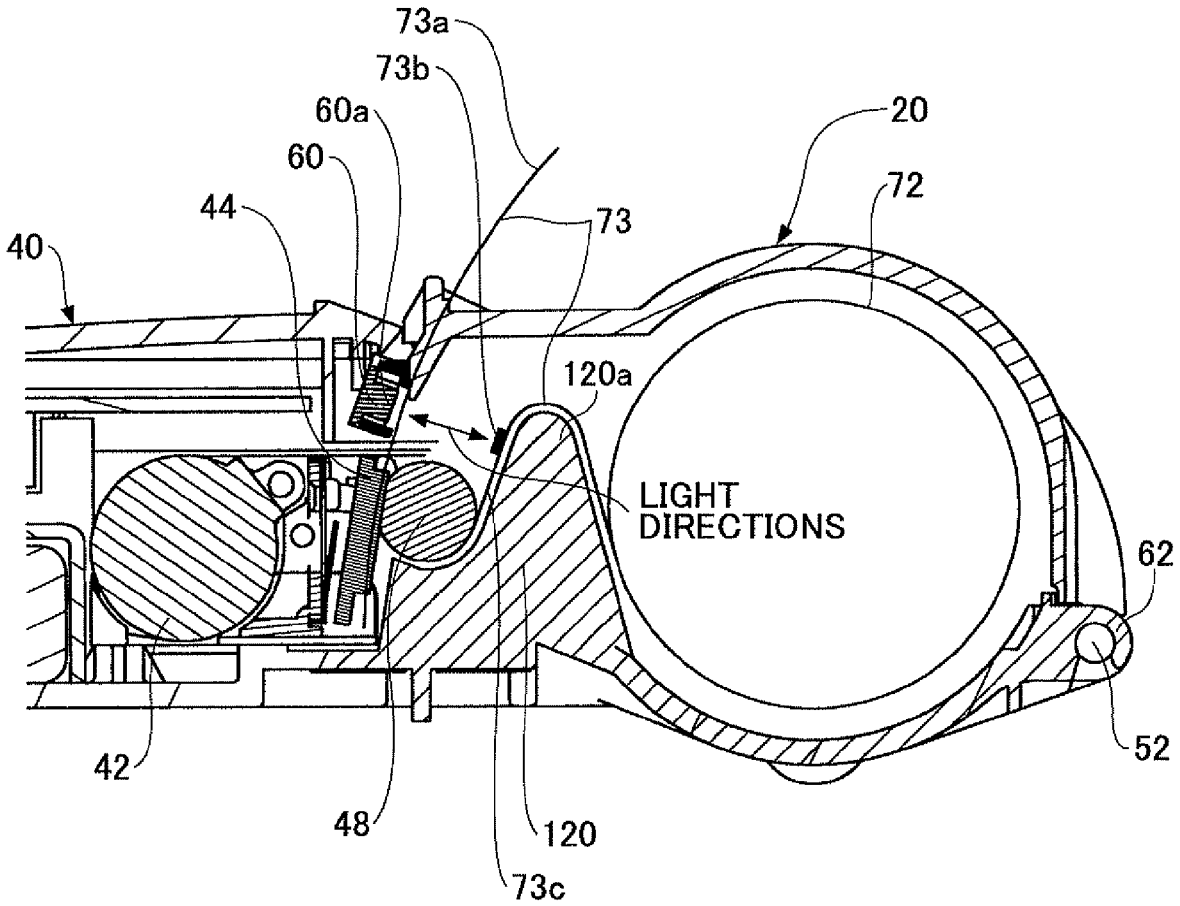
FIG. 33 is a cross-sectional view of a printer with the lid part closed according to a fifth embodiment of the present invention.

FIG. 33 is a cross-sectional view of the printer of this embodiment with the lid part 20 closed. According to this embodiment, the mark detecting part 60 is an optical sensor as described above. A brief description is given of the optical sensor. The mark detecting part 60, which is an optical sensor, includes a light-emitting part and a light-receiving part (not graphically illustrated). The light-emitting part emits light to a reverse side 73*c* of the paper 73. The light-receiving part (the mark reading surface 60*a*) receives light reflected back from the reverse side 73*c* of the paper 73. Further, it is assumed that the mark 73*b* added to the reverse side 73*c* of the paper 73 is black and the region of the reverse side 73*c* of the paper 73 other than the mark 73*b* is white. In this case, the level of light amount of light reflected back from the region of the paper 73 other than the mark 73*b* is high while the level of light amount of light reflected back from the mark 73*b* of the paper 73 is low.

A threshold is predetermined with respect to the level of light amount, and it is determined that the reflected light is from the region other than the mark 73*b* if the amount of light level of the reflected light is higher than or equal to the threshold, that is, it is determined that the mark detecting part 60 has not detected the mark 73*b*. On the other hand, if the level of light amount is lower than the threshold, it is determined that the reflected light is from the mark 73*b*, that is, it is determined that the mark detecting part 60 has detected the mark 73*b*.

As illustrated in FIG. 33, the printer of this embodiment includes an opposing part 120, and has the mark detecting part 60 provided in the body part 40. In the case of FIG. 33, the opposing part 120 is a paper guide configured to cause the reverse side 73*c* of the paper 73 to be opposed to the mark reading surface 60*a* of the mark detecting part 60. The opposing part 120 is provided in the paper conveyance path. The paper conveyance path is a path from the paper roll 72 up to a position where the platen roller 48 and the printing head 44 are in press contact (that is, a printing part that performs printing on the printing surface 73*a* of the paper 73). Further, the reverse side 73*c* is a surface on the side opposite to the printing surface 73*a* on which letters or characters are printed. As illustrated in FIG. 33, the opposing part 120 includes a rising portion 120*a*.

By causing the paper 73 to be conveyed along the rising portion 120*a*, it is possible to change the orientation of the reverse side 73*c* of the paper 73, so that it is possible to cause the reverse side 73*c* of the paper 73 to be opposed to the mark reading surface 60*a* of the mark detecting part 60.

Thus, according to the printer of this embodiment, it is possible to have the mark detecting part 60 provided on the body part 40 side. Further, by providing the opposing part 120, it is possible to cause the mark reading surface 60*a* of the mark detecting part 60 and the reverse side 73*c* of the paper 73 to be opposed to each other. As a result, it is possible for the mark detecting part 60 to properly detect the mark 73*a* added to the reverse side 73*c* of the paper 73.

Thus, according to the printer of this embodiment, it is possible to properly detect the mark 73*a* added to the reverse side 73*c* of the paper 73 while having the mark detecting part 60 provided in the body part 40.

[f] Sixth Embodiment

Next, a description is given of a printer according to a sixth embodiment.

According to the printer of this embodiment, instead of using a power feed line and a transmission part, an electric current may be supplied and a mark detection signal may be transmitted in a contactless manner. Accordingly, it is possible to solve the above-described problems such as a failure to transmit a mark detection signal from a mark detection part to a control part due to the severance or breakage of a transmission part and a failure to supply electric power to the mark detecting part due to the breakage of a power feed line.

Figure 34:
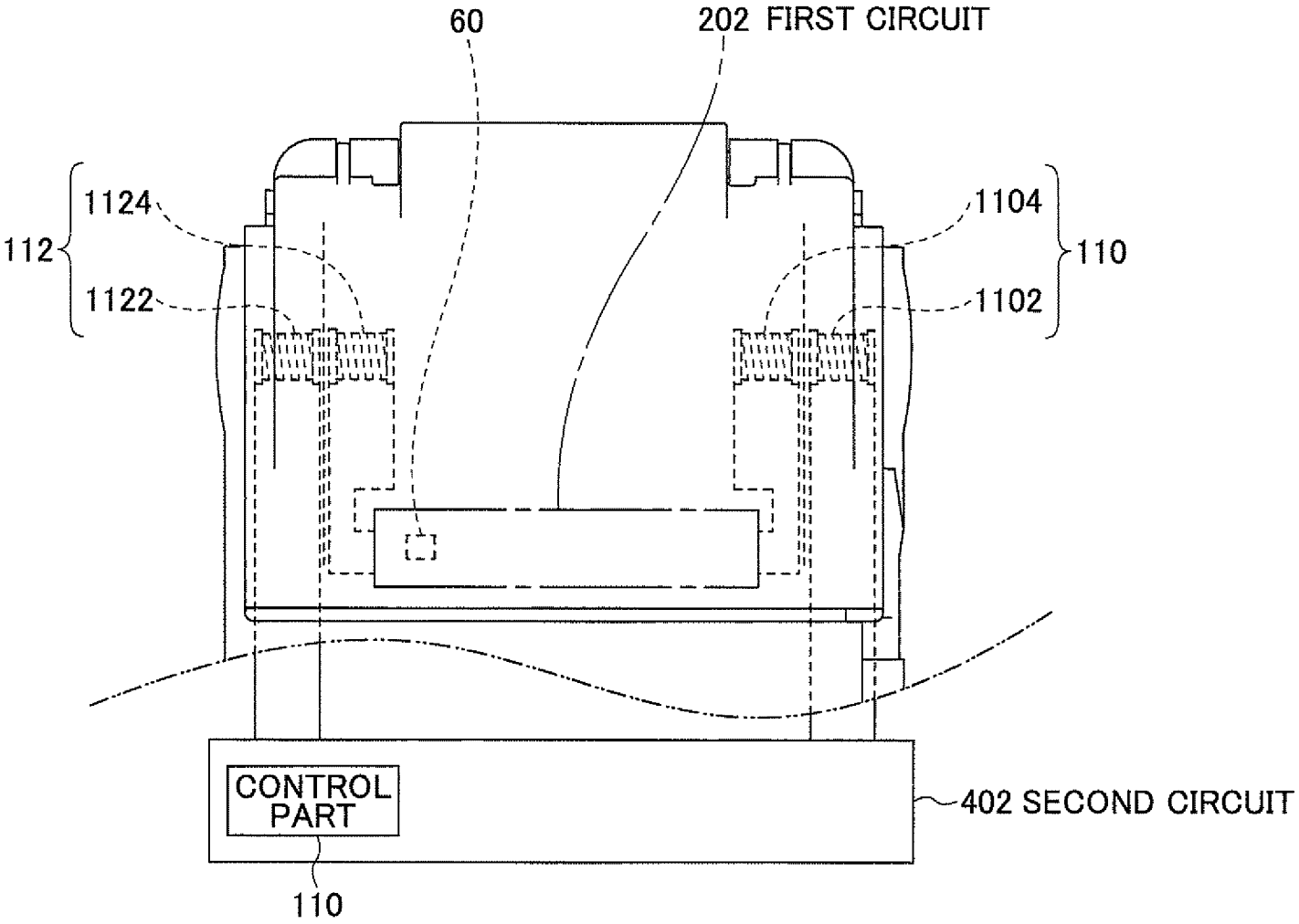
FIG. 34 is a transparent view of a printer according to a sixth embodiment of the present invention, taken through the lid part closed.

FIG. 34 is a transparent view of the printer of this embodiment, taken through the lid part 20 closed, illustrating a functional configuration of the printer. The mark detecting part 60 is provided in a first circuit 202 provided in the lid part 20. Further, the control part 110 (FIG. 6) is provided in a second circuit 402 provided in the body part 40.

Upon closure of the lid part 20, a first coil pair 110 and a second coil pair 112 are formed. The first coil pair 110 includes a pair of first coils 1102 and 1104, which are so opposed to each other as to cause electromagnetic induction. Further, the second coil pair 112 includes a pair of second coils 1122 and 1124, which are so opposed to each other as to cause electromagnetic induction. Further, the first coil 1102 and the second coil 1122 are body-part-side coils provided in the body part 40, and the first coil 1104 and the second coil 1124 are lid-part-side coils provided on the lid part 20.

The first coil 1102 and the second coil 1122 have respective first and second ends connected to the second circuit 402 in the body part 40. Further, the first coil 1104 and the second coil 1124 have respective first and second ends connected to the first circuit 202 in the lid part 20.

Figure 35:
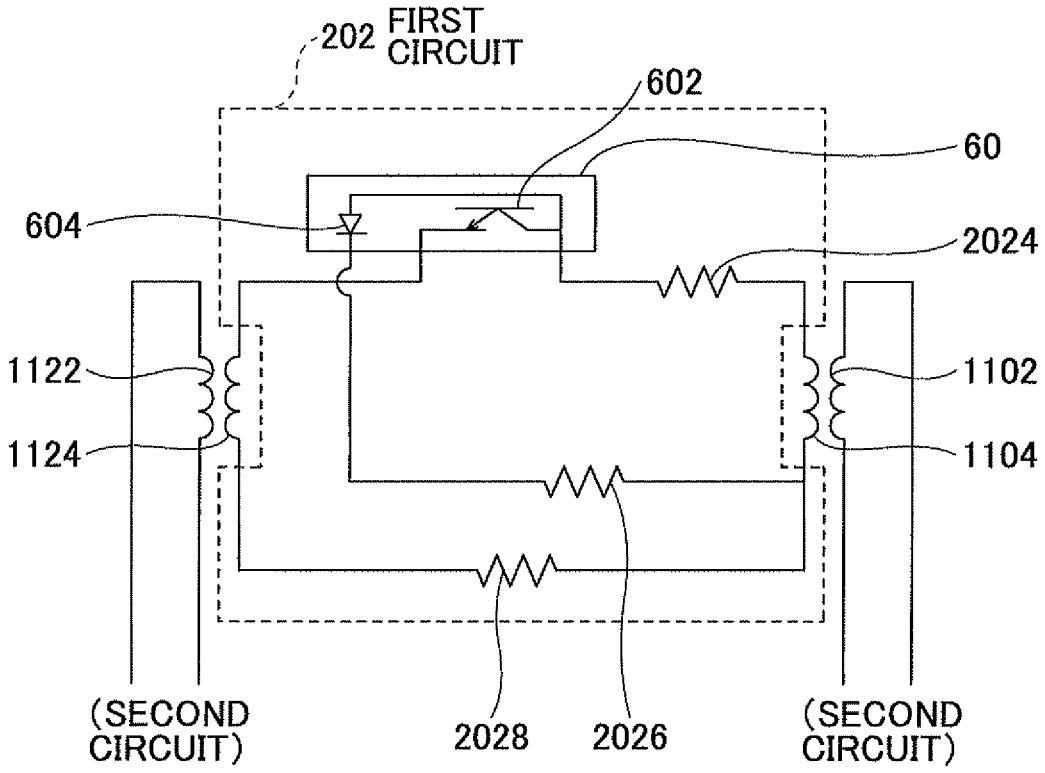
FIG. 35 is a circuit diagram of a first circuit in the lid part according to the sixth embodiment of the present invention.

FIG. 35 is a circuit diagram of the first circuit 202 in the lid part 20. In the case illustrated in FIG. 35, the mark detecting part 60 is described as a photosensor. However, the mark detecting part 60 may use other sensors. In the case of FIG. 35, the mark detecting part 60 includes a transistor 602 and a diode 604.

Figure 36:
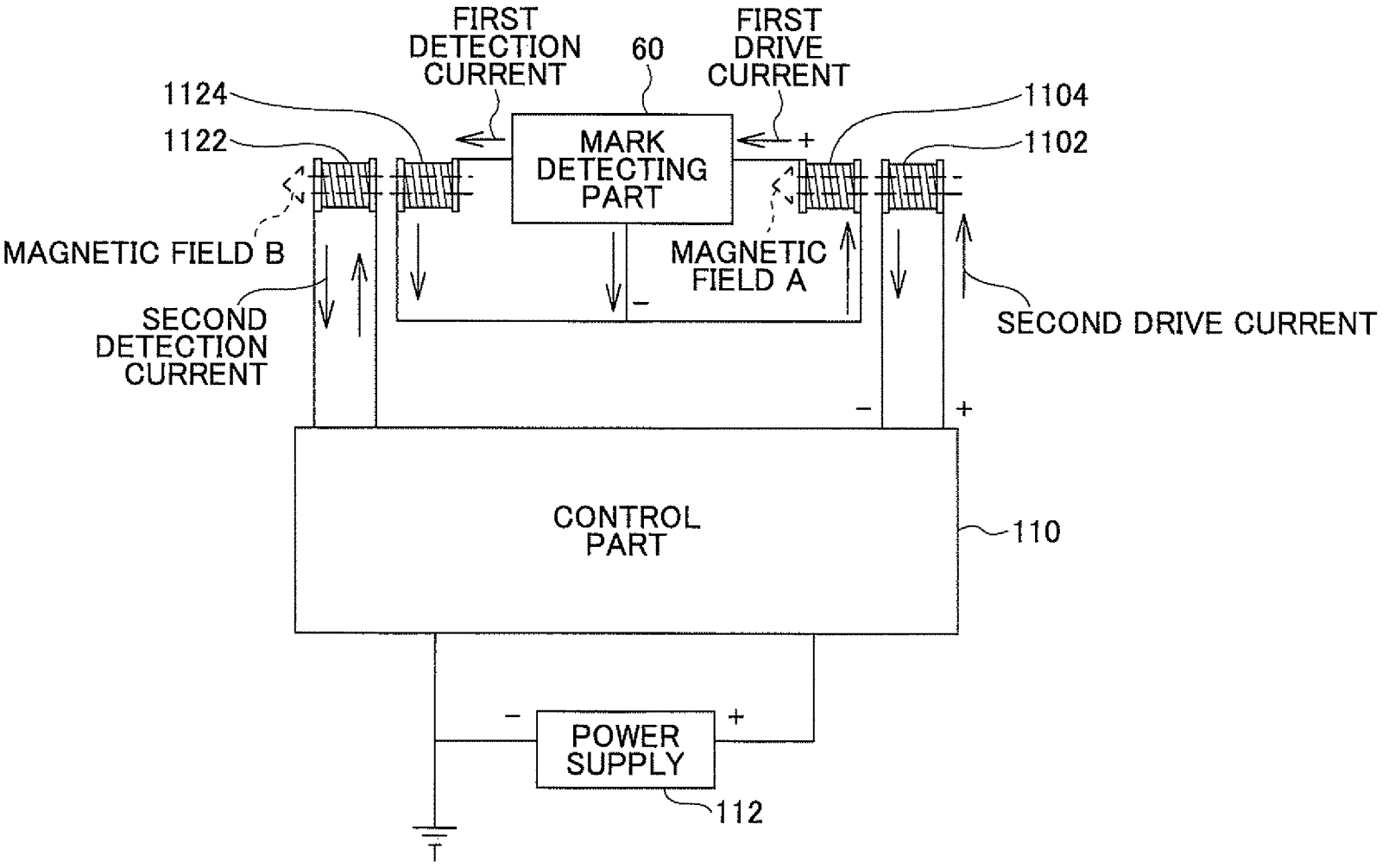
FIG. 36 is a diagram illustrating a first coil pair, etc., according to the sixth embodiment of the present invention.

Further, FIG. 36 is a diagram illustrating an electric current input to and output from the mark detecting part 60, magnetic fields, etc. A description is given below, using FIG. 35 and FIG. 36, of a method of driving the mark detecting part 60 and a method of detecting the mark 73*b* (FIG. 9) according to this embodiment.

First, a description is given of a method of driving the mark detecting part 60. First, an electric current is supplied from the power supply 112 to the control part 110. The control part 110 feeds the supplied electric current (hereinafter referred to as "second drive current") to the first coil 1102. Here, the second drive current is an alternating current.

Then, since the second drive current is an alternating current, a change is caused in Magnetic Field A (also referred to as "first magnetic field") in the first coil 1102. In FIG. 36, Magnetic Field A is illustrated with only one direction, but the direction of Magnetic Field A changes at short time intervals.

This magnetic field variation causes electromagnetic induction between the first coils 1102 and 1104. As a result of this electromagnetic induction, an electric current (hereinafter referred to as "first drive current") is generated from the first coil 1104. The generated first drive current is input to the mark detecting part 60 via a resistor 2024. The mark detecting part 60 is driven with the input first drive current. In more detail, the first drive current is input to the transistor 602 and the diode 604 (FIG. 35) inside the mark detecting part 60.

The first drive current generated by this electromagnetic induction also is an alternating current. Therefore, the first drive current is intermittently supplied to the mark detecting part 60, so that the mark detecting part 60 is driven in units of ms. However, driving the mark detecting part 60 in units of ms causes no problem in mark detection.

Next, a description is given of a mark detecting method of the mark detecting part 60. According to this embodiment, the mark detecting part 60 serves as an optical sensor with the transistor 602 serving as a light-receiving element and the diode 604 serving as a light-emitting element. When the transistor 602 and the diode 604 are supplied with the first drive current, the diode 604 emits light to the paper 73 (FIG. 9) that is being conveyed. Then, the transistor 602 receives light reflected back from the paper 73.

Here, for simplification of description, it is assumed that the paper 73 is white and the mark 73*b* added in advance to the paper 73 is black. Further, a region where the mark 73*b* is added is referred to as "mark region," and of the entire region (of the reverse side 73*c*) of the paper 73, the region other than the mark 73*b* is referred to as "extra-mark region." The mark region is black and the extra-mark region is white. The level of light amount of light reflected back from the extra-mark region is high. On the other hand, the level of light amount of light reflected back from the mark region is low. The transistor 602, which serves as a light-receiving element, outputs an electric current corresponding to the level of light amount of the reflected light (hereinafter referred to as "first detection current"). The output first detection current is input to the second coil 1124.

In the case of the diode 604 switching from the time of emitting light to the extra-mark region to the time of emitting light to the mark region, a change is caused in the level of light amount of the reflected light received by the transistor 602 (the level of light amount decreases). With this change, the first detection current output from the transistor 602 also changes. As described above, the first detection current is input to the second coil 1124. Therefore, Magnetic Field B (also referred to as "second magnetic field") is generated. The first detection current changes every time the mark 73*b* is detected. Therefore, the generated Magnetic Field B also changes. This change in Magnetic Field B causes electromagnetic induction between the second coil 1122 and the second coil 1124. This electromagnetic induction generates an electric current (hereinafter referred to as "second detection current") in the second coil 1124. The generated second detection current is input to the control part 110.

That is, the control part 110 recognizes the time of input of the second detection current as the time of detection of the mark 73*b* by the mark detecting part 60.

In FIG. 35, a resistor 2026 and a resistor 2028 are provided in order to make a difference in potential.

According to the printer of this embodiment, the first coil pair 110 is provided in place of a power feed line, and the second coil pair 112 is provided in place of a transmission part. As a result of this configuration, there may be no contact (no wired connection) between the mark detecting part 60 and the control part 110, so that it is possible to solve the above-described problems.

Thus, according to this embodiment, it is possible to provide a printer free of the above-described problems.

[g] Seventh Embodiment

Next, a description is given of a printer according to the seventh embodiment.

Figure 37:
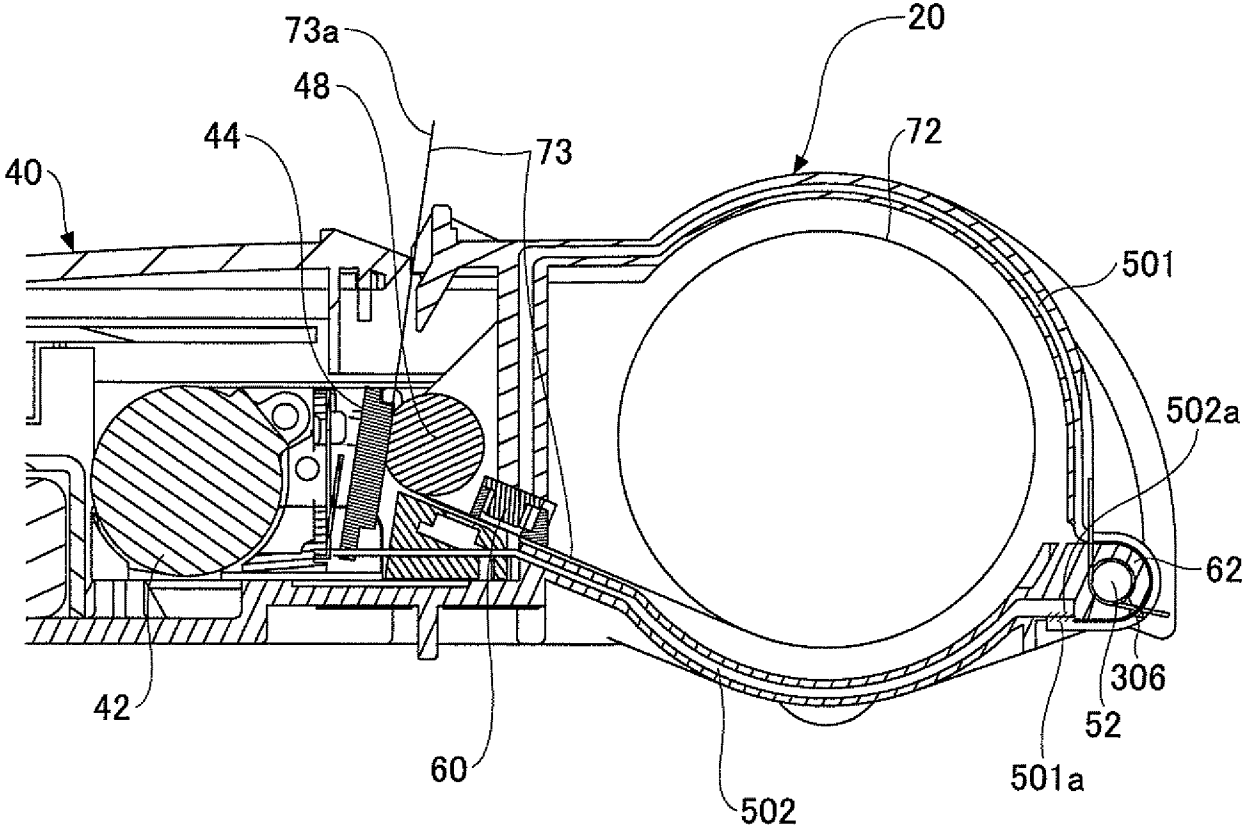
FIG. 37 is a cross-sectional view of a printer with the lid part closed according to a seventh embodiment of the present invention.
Figure 38:
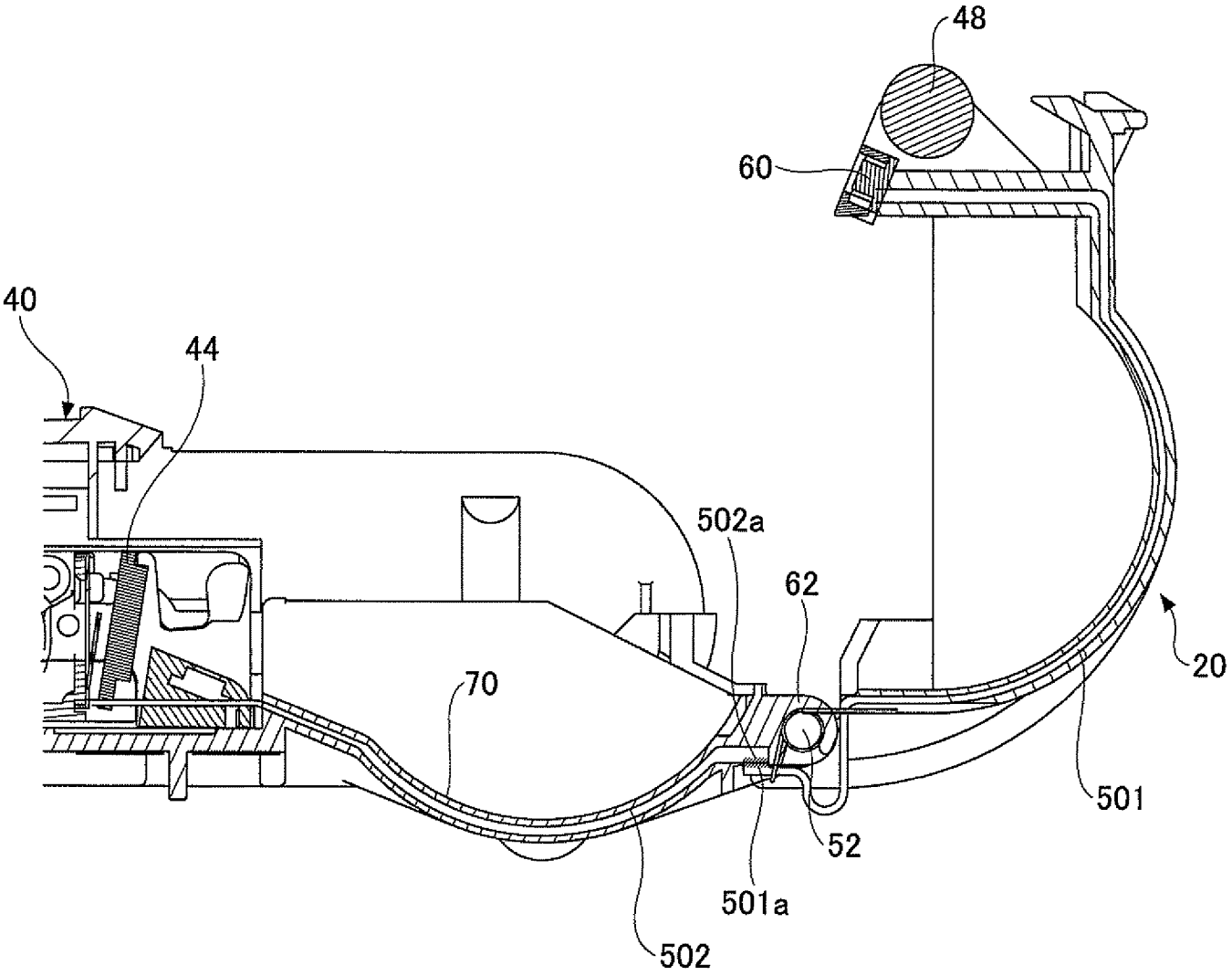
FIG. 38 is a cross-sectional view of the printer with the lid part open according to the seventh embodiment of the present invention.

FIG. 37 is a cross-sectional view of the printer of this embodiment with the lid part 20 closed. FIG. 38 is a cross-sectional view of the printer of this embodiment with the lid part 20 open. The printer of this embodiment includes the lid part 20 and the body part 40. The lid part 20 includes the first rotating shaft 52, and the body part 40 includes the first engaging part 62. The first rotating shaft 52 is removably engaged with the first engaging part 62 so as to allow the lid part 20 to rotate relative to the body part 40. The details of the engagement are as illustrated in FIGS. 12A and 12B, and accordingly, a description thereof is omitted. For example, in cases such as when a user opens the lid part 20 with an excessive force, the first rotating shaft 52 is removed from the first engaging part 62, so that the lid part 20 and the body part 40 are separated. Further, the printer of this embodiment has the mark detecting part 60 provided at the end of the lid part 20. The mark detecting part 60 outputs a mark detection signal in response to detecting the mark 73*b* (FIG. 9) added in advance to the paper 73. In order to transmit the output mark detection signal to the control part (not graphically illustrated), the transmission part (FPC) 50 is provided in the lid part 20 and the body part 40 to be connected to the control part.

Figure 39:
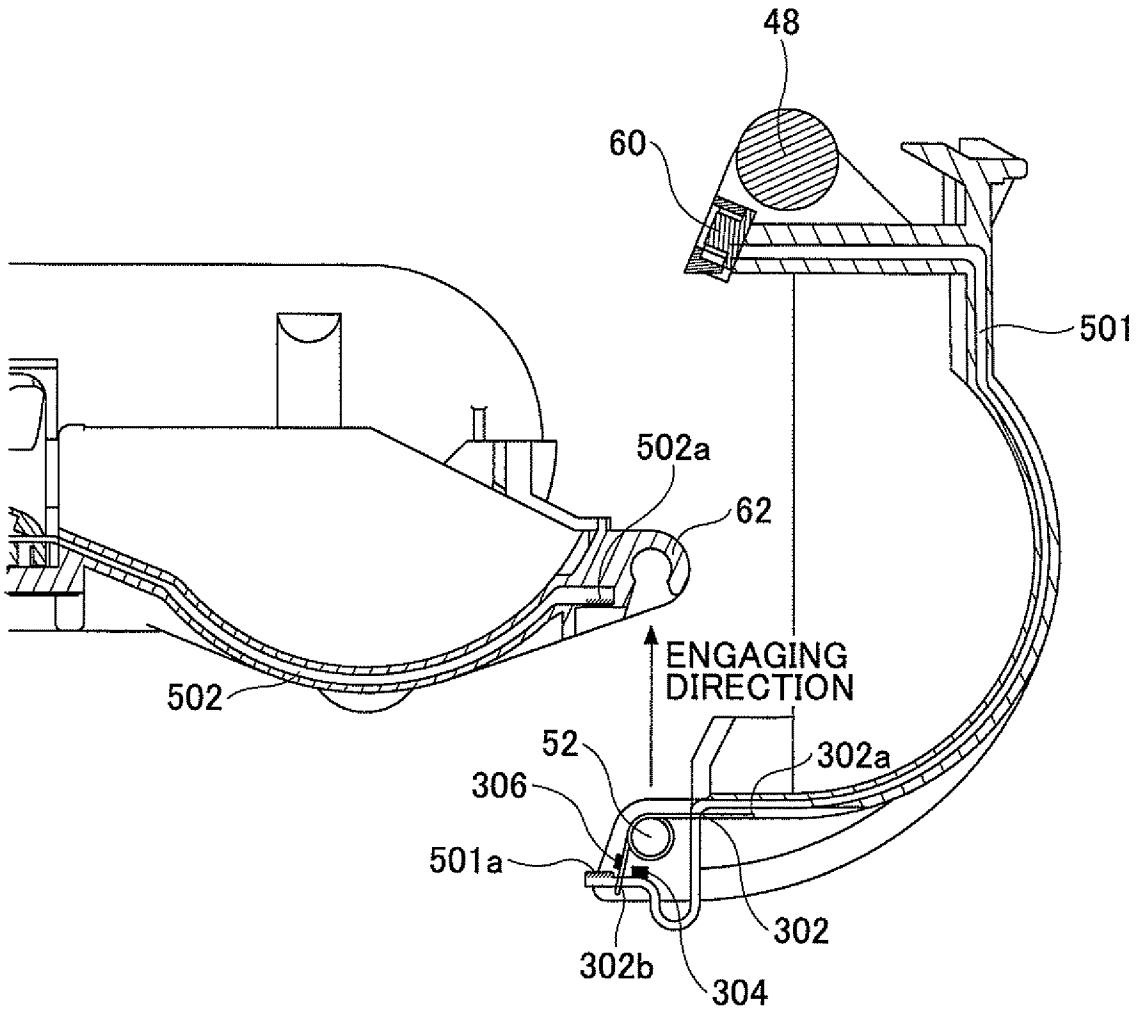
FIG. 39 is a cross-sectional view of the printer in the case where the first rotating shaft is removed from the first engaging part according to the seventh embodiment of the present invention.

FIG. 39 is a cross-sectional view of the printer of this embodiment in the case where the lid part 20 and the body part 40 are separated. As illustrated in FIG. 39, the transmission part (FPC) 50 of this embodiment is so configured as to be severed (separated) when the lid part 20 and the body part 40 are separated. The transmission part (FPC) 50 is separable into a first transmission part 501 provided in the lid part 20 and a second transmission part 502 provided in the body part 40. The first transmission part 501 has a first terminal 501*a* at an end on the side opposite to the mark detecting part 60. The second transmission part 502 has a second terminal 502*a* at an end on the side opposite to the control part (not graphically illustrated).

Further, the printer of this embodiment includes a connecting part. A user is allowed to engage the first rotating shaft 52 with the first engaging part 62 (that is, to integrate the separated lid part 20 with the body part 40), and to electrically connect the separated portions of the transmission part (FPC) 50 with the connecting part. Here, to "electrically connect" means to "establish such an electrical connection as to allow a mark detection signal from the mark detecting part 60 to be transmitted."

There are various configurations for the connection part. According to this embodiment, a description is given of two configurations for the connection part by way of example.

First, a description is given of a first configuration for the connecting part.

FIG. 39 illustrates the first configuration for the connecting part. According to the first configuration, the connecting part is an urging part. In FIG. 39, this urging part is illustrated as a spring 302. However, the urging part may be other members as long as they have an urging force. Further, in the following description, a direction in which the first rotating shaft 52 is engaged with the engaging part 62 is referred to as "engaging direction" as illustrated in FIG. 39. In the case of FIG. 39, the spring 302 is wound around the first rotating shaft 52. The spring 302 has a first end 302*a* fixed to the frame (not graphically illustrated) of the lid part 20. The spring 302 has a second end 302*b* pressing the first terminal 501*a* in the engaging direction. That is, immediately before the first rotating shaft 52 is engaged with the first engaging part 62 (in the state of FIG. 39), the first terminal 501*a* and the second terminal 502*a* are caused to face (are opposed to) each other by the pressing of the spring 302. In FIG. 39, the second end 302*b* of the spring 302 penetrates through the transmission part 50 (the first transmission part 501). However, the second end 302*b* may not penetrate through the transmission part 50.

A transmission part controlling part 304, which may be referred to as "interconnect stopper," is provided. The transmission part controlling part 304 is configured to control the first terminal 501*a* in order to prevent the first terminal 501*a* from being oriented to a direction to not face the second terminal 502*a* because of excessive urging of the spring 302. The transmission part controlling part 304 may be omitted.

FIG. 38 illustrates a state where the first rotating shaft 52 is engaged with the first engaging part 62 by a user. As described above, immediately before the first rotating shaft 52 is engaged with the first engaging part 62, the first terminal 501*a* and the second terminal 502*a* are caused to face each other by the pressing of the spring 302. Upon engagement of the first rotating shaft 52 with the first engaging part 62, the first terminal 501*a* and the second terminal 502*a* are electrically connected.

Here, a fixing part is used in order to ensure the connection of the first terminal 501*a* and the second terminal 502*a*. The fixing part may be implemented by shaping the first terminal 501*a* and the second terminal 502*a* like connectors. The fixing part may be implemented by other techniques as long as it is possible to ensure the connection of the first terminal 501*a* and the second terminal 502*a*. By shaping the first terminal 501*a* and the second terminal 502*a* like connectors, the first terminal 501*a* and the second terminal 502*a* are detachably and reattachably connected.

Further, the printer of this embodiment includes an urging part controlling part 306, which may be referred to as "spring stopper." By providing the urging part controlling part 306, it is possible to prevent the spring 302 from performing urging in an improper direction whether the lid part 20 is closed (in the state of FIG. 37 or open (in the state of FIG. 38). The urging part controlling part 306 may be omitted.

According to the above description, the first transmission part 501 is urged with the spring 302. Alternatively, however, the first terminal 501*a* and the second terminal 502*a* may be caused to face each other by urging the second transmission part 502. Further, the spring 302 may also be configured to urge the first transmission part 501 and the second transmission part 502.

A description is given above of a printer that employs the spring 302 as the connection part. Inclusion of this connecting part makes it possible for a user to engage the first rotating shaft 52 with the first engaging part 62 and to electrically connect the first terminal 501*a* and the second terminal 502*a*.

Next, a description is given of a second configuration for the connecting part.

Figure 40:
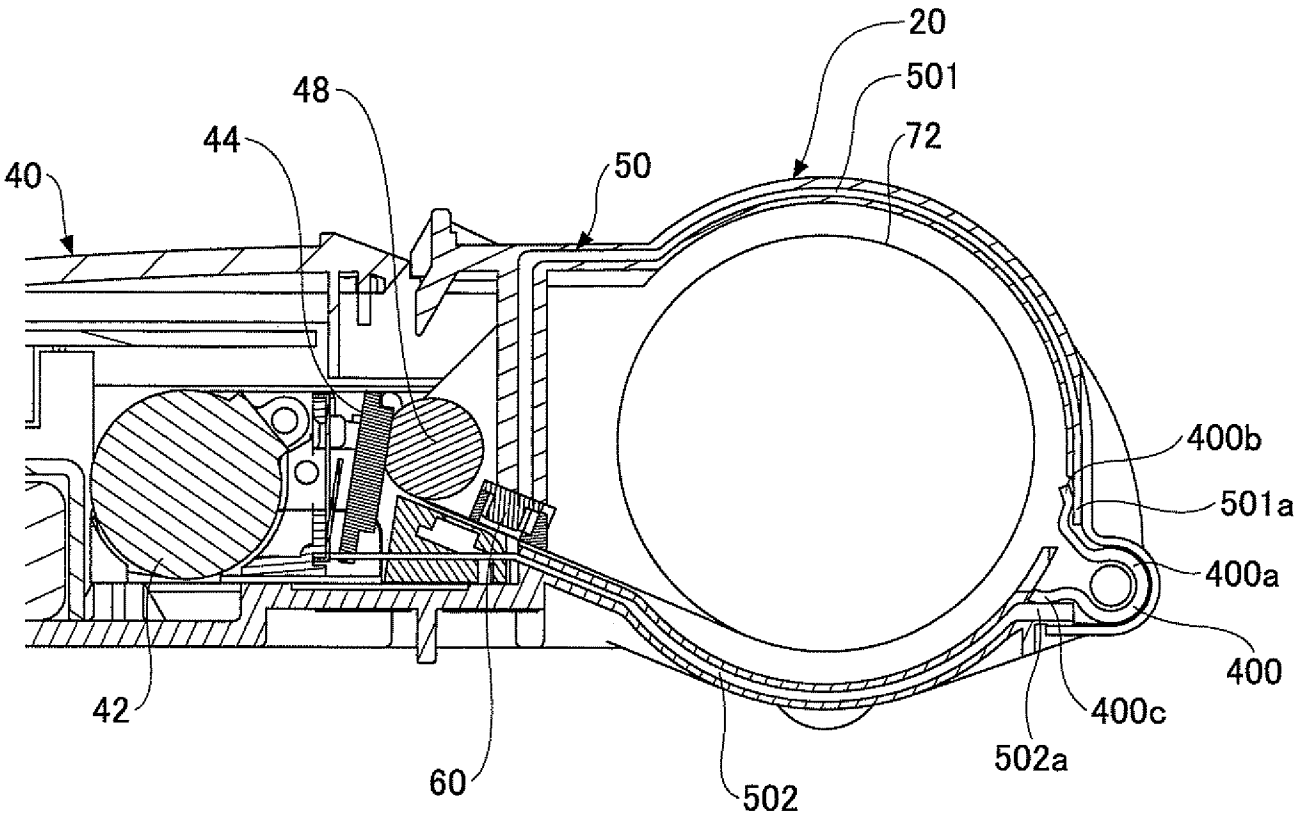
FIG. 40 is a cross-sectional view of the printer with the lid part closed according to the seventh embodiment of the present invention.

FIG. 40 is a cross-sectional view of the printer with the lid part 20 closed. As illustrated in FIG. 40, the printer includes a connecting part 400. The connecting part 400 is electrically conductive. Preferably, the connecting part 400 is elastic. Here, being "electrically conductive" means to "be able to electrically conduct a mark detection signal from the mark detecting part 60." Further, as described above, the transmission part (FPC) 50 is provided in order to transmit a mark detection signal from the mark detecting part 60 to the control part. According to this embodiment, the mark detection signal is transmitted from the mark detecting part 60 to the first transmission part 501 provided on the lid part 20 side to the connection part 400 to the second transmission part 502 on the body part 40 side to the control part. The transmission part (FPC) 50 of this embodiment includes the first transmission part 501 and the second transmission part 502.

Further, in this case, the connection part 400 includes a curved portion 400*a* and has a substantially U-letter shape. The curved portion 400*a* is disposed so as to surround the first rotating shaft 52. Further, the connecting part 400 includes a first end 400*b* and a second end 400*c*. With the lid part 20 closed, the first end 400*b* is immovably connected electrically to the first terminal 501*a* and the second end 400*c* is removably connected electrically to the second terminal 502*a*. Accordingly, it is possible to properly transmit a mark detection signal from the mark detecting part 60 to the control part.

Figure 41:
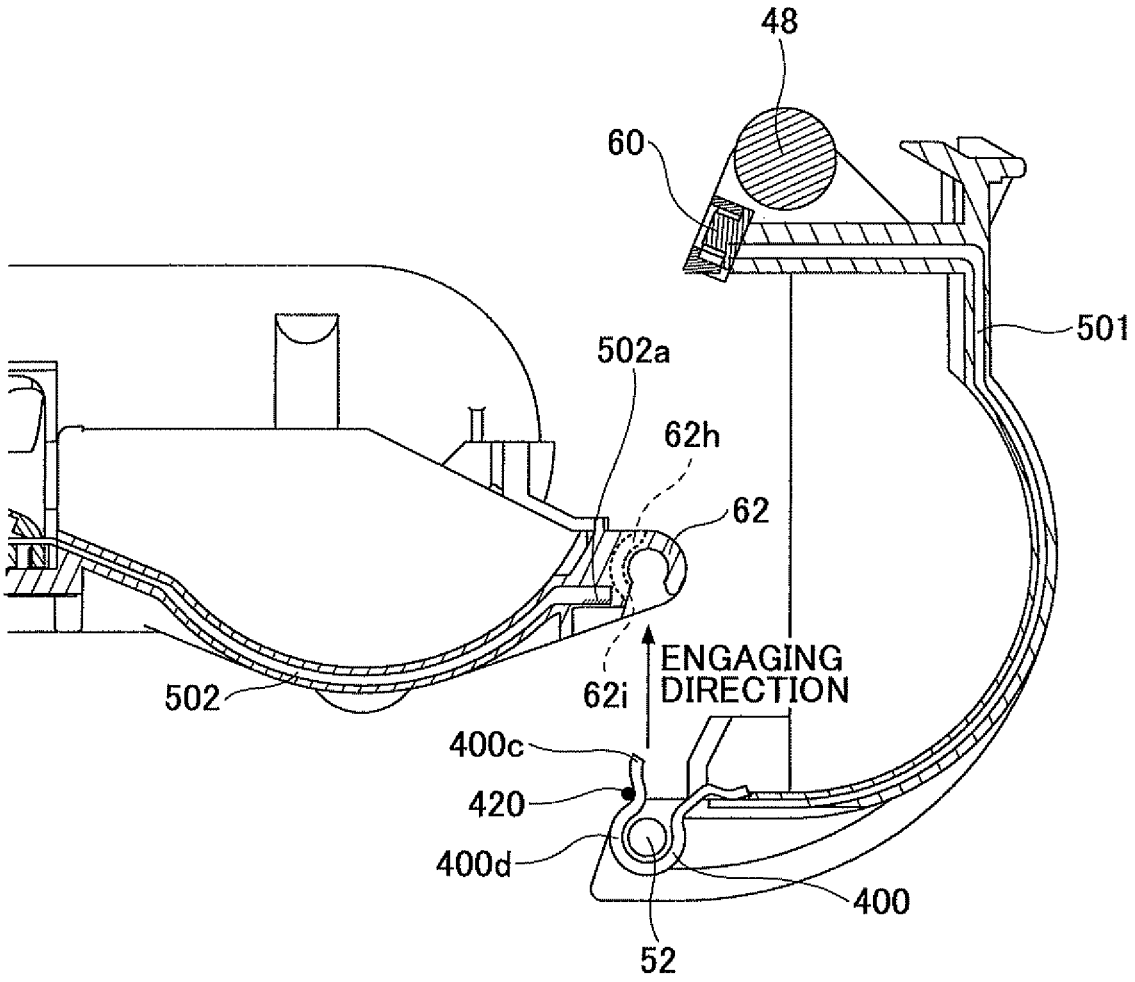
FIG. 41 is a cross-sectional view of the printer in the case where the first rotating shaft is removed from the first engaging part according to the seventh embodiment of the present invention.

FIG. 41 is a cross-sectional view of the printer in the case where the first rotating shaft 52 is removed from the first engaging part 62 because the lid part 20 has been opened with an excessive force by a user. As illustrated in FIG. 41, upon removal of the first rotating shaft 52 from the first engaging part 62, the connected second terminal 502*a* and the second end 400*c* are separated (their electrical connection is broken). That is, the second end 400*c* of the connection part 400 is connected electrically to the second terminal 502*a* in such a manner as to allow their electrical connection to be broken. Accordingly, even in the case of separation of the lid part 20 and the body part 40, the transmission part 50 is allowed to be smoothly separated. According to this embodiment, the separation of the transmission part 50 is the separation of "the first transmission part 501 and the connecting part 400" and "the second transmission part 502." That is, the first transmission part 501 and the connecting part 400 are unremovably connected electrically, and the connection part 400 and the second transmission part 502 are removably connected electrically.

Figure 42:
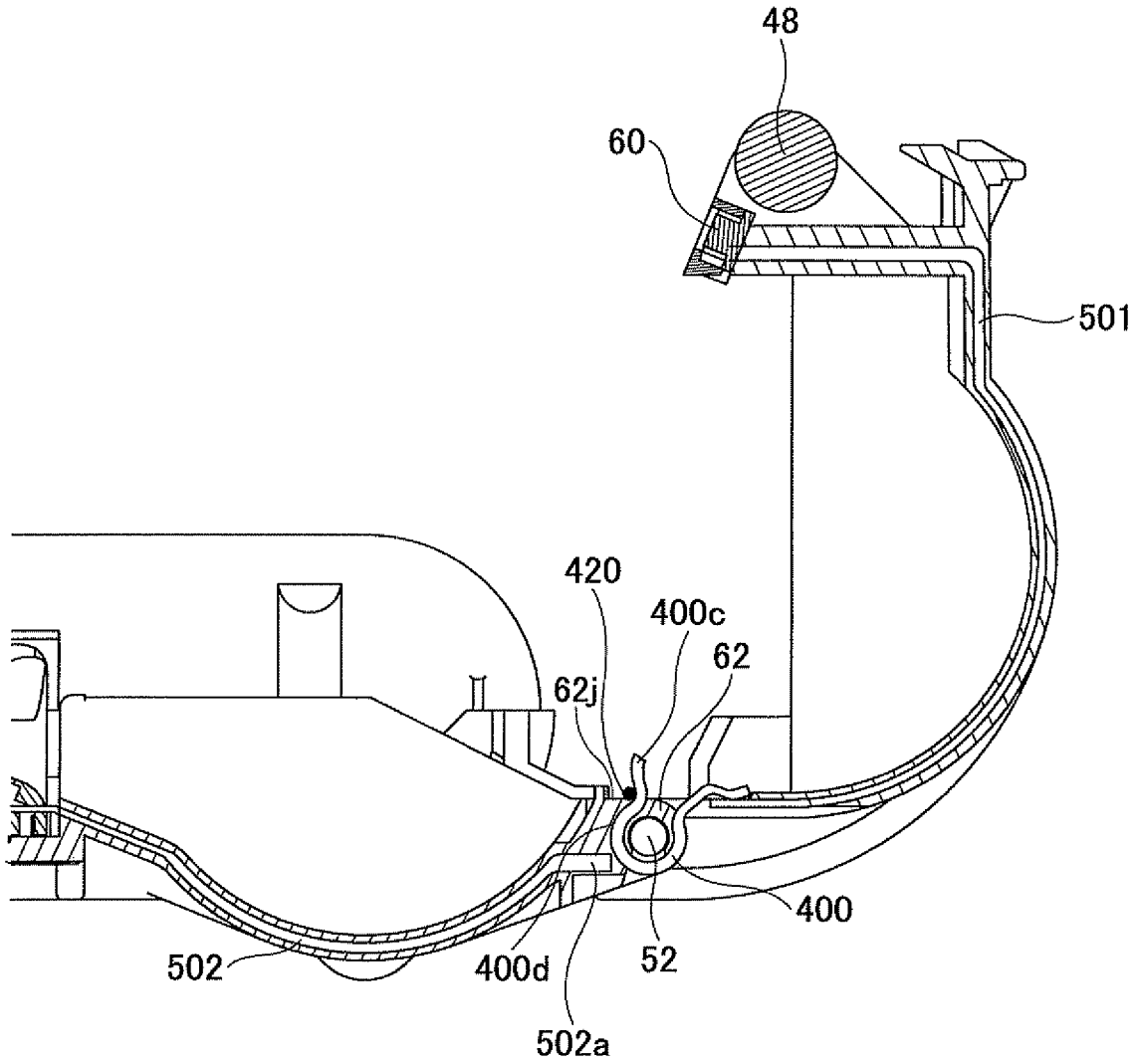
FIG. 42 is a cross-sectional view of the printer with the lid part open according to the seventh embodiment of the present invention.

FIG. 42 is a cross-sectional view of the printer in the case where the first rotating shaft 52 is engaged with the first engaging part 62. A through hole 62*h* is formed in the first engaging part 62. The connecting part 400, which penetrates through the through hole 62*h*, has a penetration part 400*d* configured to penetrate through the through hole 62*h*. Upon engagement of the first rotating shaft 52 with the first engaging part 62 by a user, the penetration part 400*d* of the connecting part 400 penetrates through the through hole 62*h* (FIG. 42). The penetration part 400*d* has an end portion 400*c* formed at its end.

Further, a stopper 420 is provided on the penetration part 400*d* of the connecting part 400 (near the end portion 400*c*) so as to allow the penetration part 400*d* to smoothly penetrate through the through hole 62*h*. The stopper 420 allows the end portion 400*c* of the connecting part 400 to be oriented to an entrance 62*i* of the through hole 62*h* immediately before the end portion 400*c* is caused to penetrate through the through hole 62*h*. Further, as described above, the connecting part 400 is elastic. Accordingly, the state of FIG. 42 is entered when the end portion 400*c* of the connection part 400 penetrates through the through hole 62*h* at the same time that the first rotating shaft 52 is engaged with the first engaging part 62 by a user. In the state where the lid part 20 is open (the state of FIG. 42), the connecting part 400 is not in contact with (not electrically connected to) the second terminal 502*a*. This is because when the lid part 20 is open, there is no need to drive the mark detecting part 60 and no mark detection signal is output from the mark detecting part 60. The connecting part 400 and the second terminal 502*a* may be electrically connected when the lid part 20 is open as well. Further, in the state where the lid part 20 is closed (the state of FIG. 40), in order to drive the mark detecting part 60 to output a mark detection signal from the mark detecting part 60, the connecting part 400 and the second transmission part 502 are electrically connected.

In the state of FIG. 42, the stopper 420 is in contact with a contact surface 62*j* of the first engaging part 62. With the lid part 20 open, the stopper 420 is in contact with the contact surface 62*j* to fix the connecting part 400.

According to the printer of this embodiment, the first rotating shaft 52 is removably engaged with the first engaging part 62. Further, the transmission part 50 is configured in advance to be separable (dividable). The connecting part (the first configuration or second configuration in the above description) is provided to connect the separated portions of the transmission part 50. Accordingly, even if a user opens the lid part 20 with an excessive force so that the lid part 20 and the body part 40 are separated, it is possible to easily restore (electrically connect) the separated (portions of the) transmission part 50.

According to the printer of this embodiment, even if the lid part 20 and the body part 40 are separated and even if the transmission part (FPC) 50 is severed (separated) or broken because of an unexpected circumstance, it is possible to restore the connection.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made hereto without departing from the spirit and scope of the invention.

What is claimed is:

1. A printer, comprising:

a lid part;

a body part;

a first rotating shaft;

a second rotating shaft;

a first engaging part having the first rotating shaft removably engaged therewith so as to allow the lid part to be opened and closed relative to the body part; and a second engaging part receiving the second rotating shaft in such a manner as to allow the second rotating shaft to rotate, wherein in response to application of a first predetermined force, the first rotating shaft is removed from the first engaging part while absorbing a second predetermined force from the first predetermined force, and the lid part is allowed to rotate on the second rotating shaft to be opened and closed relative to the body part.

2. The printer as claimed in claim 1, further comprising:

one or more third rotating shafts provided between the first rotating shaft and the second rotating shaft; and one or more third engaging parts provided between the first engaging part and the second engaging part and having the corresponding one or more third rotating shafts removably and rotatably engaged therewith, wherein in response to application of a third predetermined force greater than the first predetermined force, the one or more third rotating shafts are successively removed from the corresponding one or more third engaging parts, with one of the one or more third rotating shafts closest to the first rotating shaft being removed first, while absorbing a fourth predetermined force from the third predetermined force, the fourth predetermined force being greater than the second predetermined force.

3. A printer, comprising:

a body part;

a lid part configured to be opened and closed relative to the body part;

a paper housing part configured to house paper;

a control part provided in the body part;

a mark detecting part movably provided in the body part and configured to detect a mark added to the paper in a paper conveyance path, the mark detecting part is movable between a detection-enabled position where the mark detecting part is configured to detect the mark, and a non-detection-enabled position where the mark detecting part is moved out of the paper conveyance path, the paper conveyance path being a path through which the paper is conveyed;

a spring configured to urge the mark detecting part to move toward the non-detection-enabled position; and a moving part configured to move the mark detecting part to the detection-enabled position in response to closure of the lid part, and to move the mark detecting part to the non-detection-enabled position in response to opening of the lid part;

wherein the moving part includes a holding part that is configured to move the mark detecting part to the detection-enabled position against the urging of the spring when the lid is closed, that is formed as a unit with the lid part, and that is formed to project from an inner surface of the lid part.

4. The printer as claimed in claim 3, wherein the spring has a first end provided on the body part and a second end connected to the mark detecting part.

5. The printer as claimed in claim 4, wherein the spring directly exerts a force on the mark detecting part so as to urge the mark detecting part to move toward the non-detection-enabled position.

6. The printer as claimed in claim 3, wherein the spring directly exerts a force on the mark detecting part so as to urge the mark detecting part to move toward the non-detection-enabled position.

7. A printer, comprising:

a lid part;

a body part;

a rotating shaft;

an engaging part having the rotating shaft removably engaged therewith so as to allow the lid part to be opened and closed relative to the body part;

a mark detecting part provided on the lid part and configured to output a mark detection signal in response to detecting a mark added to paper;

a transmission part configured to transmit the mark detection signal from the mark detecting part to the control part; and a connecting part, wherein the lid part and the body part are caused to be separated from each other and the transmission part is caused to be separated into multiple portions by removal of the rotating shaft from the engaging part, and the connecting part is configured to electrically connect the portions of the separated transmission part upon engagement of the rotating shaft with the engaging part.

8. The printer as claimed in claim 7, wherein:

a first one of the multiple portions of the separated transmission part is provided in the lid part and has a first terminal at an end thereof, and a second one of the multiple portions of the separated transmission part is provided in the body part and has a second terminal at an end thereof, and the connecting part is configured to urge at least one of the first terminal and the second terminal so that the first terminal and the second terminal are electrically connected upon the engagement of the rotating shaft with the engaging part.

9. The printer as claimed in claim 7, wherein:

a first one of the multiple portions of the separated transmission part is provided in the lid part and has a first terminal at an end thereof, and a second one of the multiple portions of the separated transmission part is provided in the body part and has a second terminal at an end thereof, and the connecting part is electrically conductive and has a first end thereof electrically connected to the first terminal, the connecting part being configured to have a second end thereof electrically connected to the second terminal upon the engagement of the rotating shaft with the engaging part.

* * * * *